US012415245B2

(12) United States Patent
Meek

(10) Patent No.: US 12,415,245 B2
(45) Date of Patent: Sep. 16, 2025

(54) SHARPENING DEVICE

(71) Applicant: 2WP International Pty Ltd, Rowville (AU)

(72) Inventor: Peter John Meek, Mitcham (AU)

(73) Assignee: 2WP International Pty Ltd, Victoria (AU)

( * ) Notice: Subject to any disclaimer, the term of this patent is extended or adjusted under 35 U.S.C. 154(b) by 377 days.

(21) Appl. No.: 17/286,652

(22) PCT Filed: Sep. 10, 2020

(86) PCT No.: PCT/AU2020/050960
§ 371 (c)(1),
(2) Date: Apr. 19, 2021

(87) PCT Pub. No.: WO2021/046606
PCT Pub. Date: Mar. 18, 2021

(65) Prior Publication Data

US 2022/0193853 A1 Jun. 23, 2022

(30) Foreign Application Priority Data

Sep. 10, 2019 (AU) ..... 2019903344

(51) Int. Cl.
*B24B 3/36* (2006.01)

(52) U.S. Cl.
CPC ..... *B24B 3/36* (2013.01)

(58) Field of Classification Search
CPC .. B24B 3/36; B24B 3/361; B24B 3/54; B24B 3/546; B24B 3/40; B24B 3/48;
(Continued)

(56) References Cited

U.S. PATENT DOCUMENTS 5,868,611 A * 2/1999 Friel ..... B24D 15/084 451/523
7,066,796 B2 * 6/2006 Pfaus ..... B24D 15/06 451/344

(Continued)

FOREIGN PATENT DOCUMENTS

CN 207807478 U 9/2018
TW M537958 U 3/2017

OTHER PUBLICATIONS

International Search Report and Written Opinion dated Oct. 28, 2020 for International Patent Application No. PCT/AU2020/050960, 12 pages.

*Primary Examiner* — Brian D Keller
*Assistant Examiner* — Jason Khalil Hawkins
(74) *Attorney, Agent, or Firm* — Morgan, Lewis & Bockius LLP

(57) ABSTRACT

A device for sharpening bladed tools comprising a body defining an elongate handle portion adapted to be gripped in one hand by a user, the body having a forwardly projecting support member curved or angled downwardly with respect to the handle portion and fitted with a sharpening element at or near the end thereof, wherein the support member comprises a pair of spaced support arms extending generally parallel to the longitudinal extent of the handle portion, the support arms being positioned to respective sides of the sharpening element and defining an aperture therebetween adapted to accommodate a blade or anvil of a tool during sharpening of a counterpart tool blade.

28 Claims, 24 Drawing Sheets

(58) Field of Classification Search
CPC .... B24B 3/52; B25F 1/00; B25G 1/08; B24D 15/06; B24D 15/063; B24D 15/065; B24D 15/08; B24D 15/081; B24D 15/084; B24D 15/105
USPC ..... 451/349, 553, 555, 556, 557, 558; 81/177.4, 490
See application file for complete search history.

(56) References Cited

U.S. PATENT DOCUMENTS

| | | | | |
|---|---|---|---|---|
| 7,229,344 | B1 * | 6/2007 | Wu | B24D 15/081 451/349 |
| 2011/0009040 | A1 * | 1/2011 | Wu | B24D 15/065 76/82 |
| 2012/0202410 | A1 * | 8/2012 | Byers | B24D 15/063 451/557 |
| 2018/0169818 | A1 * | 6/2018 | Wu | B24D 15/065 |
| 2020/0238551 | A1 * | 7/2020 | Behan | B25F 1/00 |

* cited by examiner

SHARPENING DEVICE

CROSS REFERENCE TO RELATED APPLICATIONS

This application is a U.S. National Phase of International Application No. PCT/AU2020/050960 filed on Sep. 10, 2020 which claims the benefit of Australian Patent Application No. 2019903344 filed Sep. 10, 2019 entitled "Sharpening Device", each of which is incorporated by reference herein in its entirety.

This invention relates to a device for sharpening bladed instruments including gardening implements and the like.

Gardening implements with blades used for cutting, such as loppers, pruners, secateurs, knives, machetes, hoes, spades, hatchets, axes, etc., should be maintained with sharp cutting edges for safe and efficient operation. Maintaining a sharp edge on the blade(s) can present a challenge for a number of reasons.

The cutting edge(s) of a gardening implement can be difficult to access due to the construction of the implement. For example, secateurs are scissor-like implements having a pair of pivoted handles and may have a single cutting blade that closes against a flat surface (anvil-type) or two cutting blades (bypass-type). For ease of operation the handles of the secateurs are usually sprung so that they are normally open, but this means the blades, or blade and anvil, are limited in their separation thereby limiting access by a sharpening tool. Moreover, oftentimes the blades, or blade and anvil, are curved, which further restricts access to the edge(s) for sharpening, particularly the base of the blade.

Not all garden cutting implements are held in one hand like secateurs. For instance, loppers may have a similar action but with long handles that are operated with both hands for extra leverage. The long handles make them unwieldy to manipulate. Accordingly, a sharpening device that can be used on a variety of different kinds of implement blades should be able to be safely and securely operated with one hand whilst the other hand holds steady the implement to be sharpened.

As mentioned above, there are cutting tools that employ two common styles of cutting action—anvil-type and bypass-type. Anvil-type secateurs work similar to a knife where a blade is pushed through the plant material onto a cutting board, i.e. the anvil. Anvil-type secateurs generally have a blade with bevels on each side of the blade edge. Bypass-type secateurs work more like scissors where two blades pass by each other, and as a result generally have blades with one flat side and one bevelled side. For optimal sharpening, different sharpening element configurations are required for use on single-bevel and double-bevel blade types. It is known to provide sharpening tools with different sharpening elements on different parts of the tool, however this compromises the tool ergonomics as well as the effective and efficient action of the tool on the blade edge.

Embodiments of the present invention aim to address the issues outlined above, or at least provide a useful alternative.

In accordance with the present invention there is provided a device for sharpening bladed tools comprising a body defining an elongate handle portion adapted to be gripped in one hand by a user, the body having a forwardly projecting support member curved or angled downwardly with respect to the handle portion and fitted with a sharpening element at or near the end thereof, wherein the support member comprises a pair of spaced support arms extending generally parallel to the longitudinal extent of the handle portion, the support arms being positioned to respective sides of the sharpening element and defining an aperture therebetween adapted to accommodate a blade or anvil of a tool during sharpening of a counterpart tool blade.

The sharpening element may be provided in a cartridge that is removeably fitted to the end of the support member. The sharpening element may comprise a one or more sharpening blades formed from tungsten carbide or the like. The device may be provided with two or more cartridges carrying sharpening blades configured for sharpening respective types of tool blade edges. The device body may have a compartment therein for storing one or more cartridges.

In accordance with the present invention there is also provided a device for sharpening bladed tools comprising a body defining an elongate handle portion adapted to be gripped in one hand by a user, the body having a forwardly projecting support member curved or angled downwardly with respect to the handle portion, the end of the support member being configured to engage with a sharpening element cartridge having a sharpening element held therein, wherein the support member comprises a pair of spaced support arms extending generally parallel to the longitudinal extent of the handle portion, the support arms being positioned to respective sides of the sharpening element of the engaged cartridge and defining an aperture therebetween adapted to accommodate a blade or anvil of a tool during sharpening of a counterpart tool blade.

The present invention also provides a device for sharpening bladed tools comprising a body defining an elongate handle portion adapted to be gripped in one hand by a user, the body having a forwardly projecting support member curved or angled downwardly with respect to the handle portion, the end of the support member being configured to engage a first sharpening element cartridge having a first sharpening element configuration for operative tool sharpening use, the device further comprising a storage receptacle formed in the body and configured to receive a second sharpening element cartridge having a second sharpening element configuration for storage, and wherein the first and second sharpening element cartridges are selectively interchangeable by the user for operative sharpening use on different types of tool blades.

In embodiments, the device includes a storage carriage adapted to engage with the sharpening element cartridge that is not, in use, fitted to the support member, the storage carriage being adapted to engage with the device body while the sharpening element cartridge carried thereby is received in the storage receptacle.

The device according to embodiments of the invention may include more than two sharpening element cartridges, with each individual sharpening element cartridge having a different sharpening element configuration adapted for sharpening a respective form of bladed tool. For example, cartridges with different sharpening element configurations may be provided for use on bypass-type loppers/secateurs, anvil-type loppers/secateurs, knives/machetes/hoes/spades, hatchets/axes, etc. The storage carriage may be arranged to hold more than one cartridge at a time for storage in the receptacle.

Further aspects, features and advantages of the present invention may become apparent from the following description of an embodiment thereof, presented by way of example only, and with reference to the accompanying drawings, in which.

Figure 23:
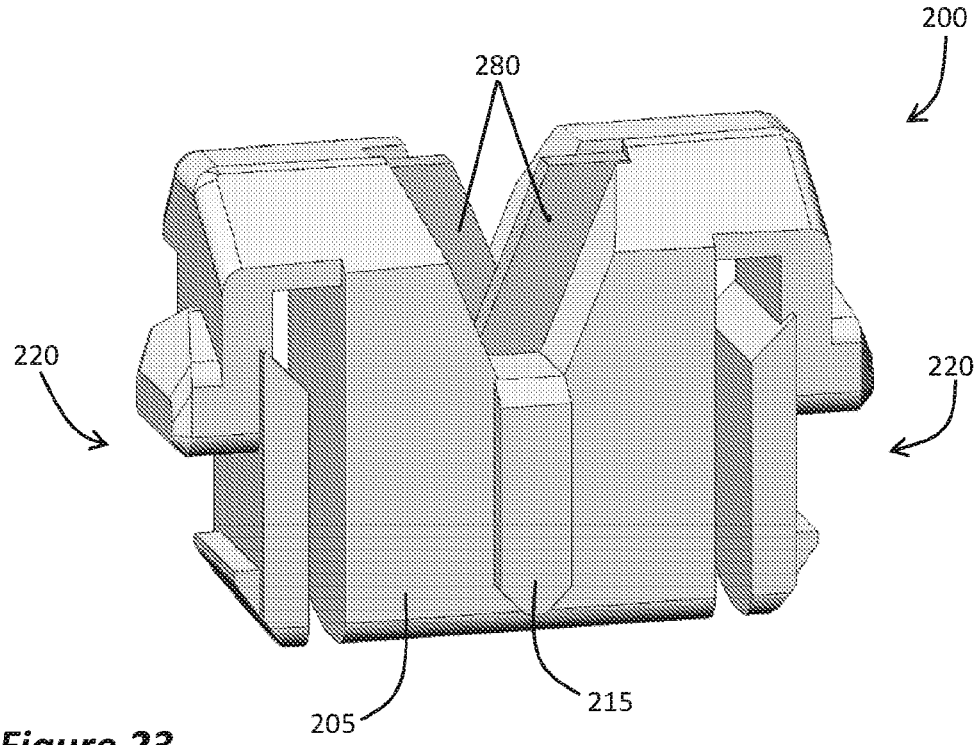
Figure 24:
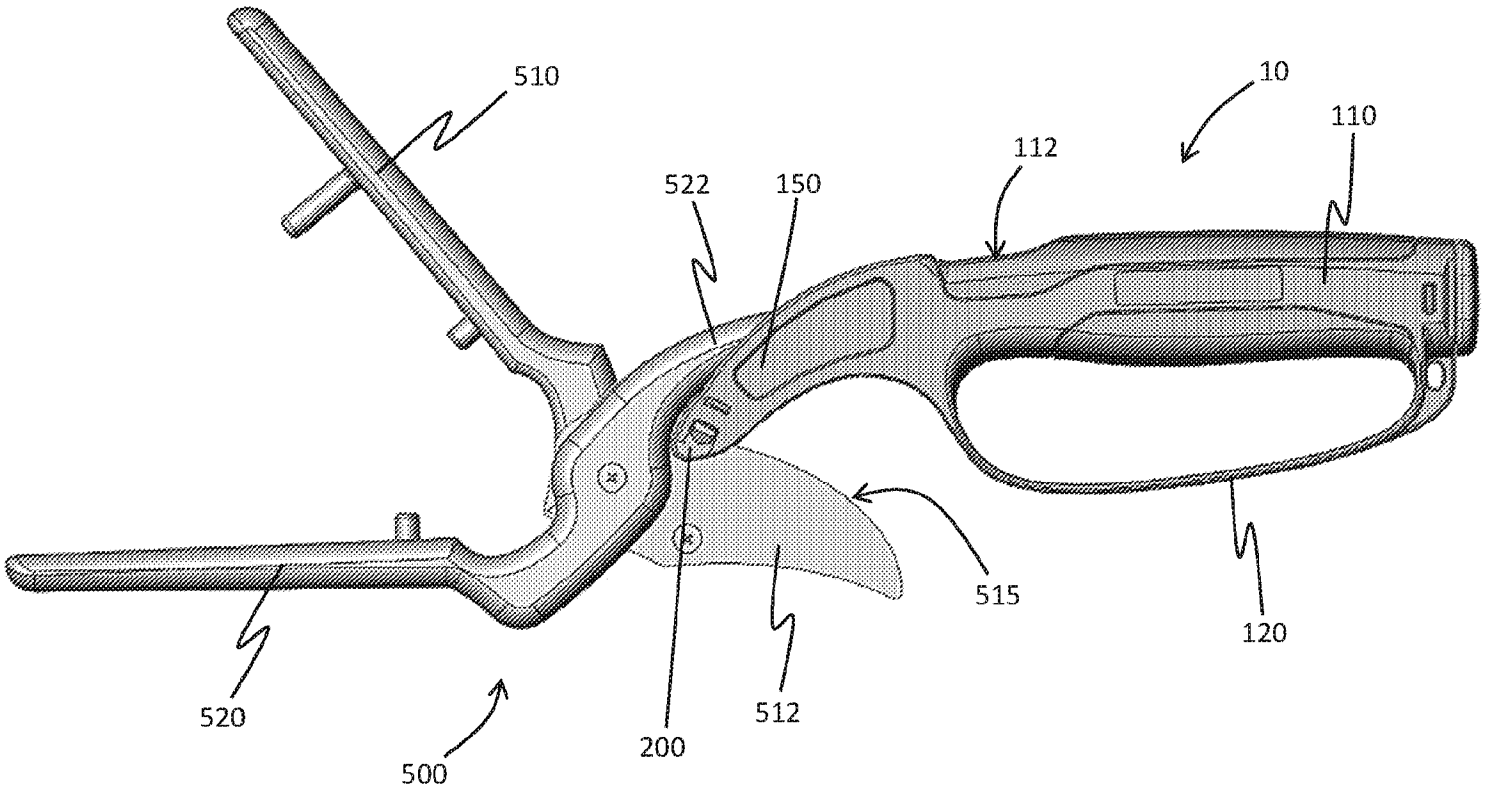
Figure 25:
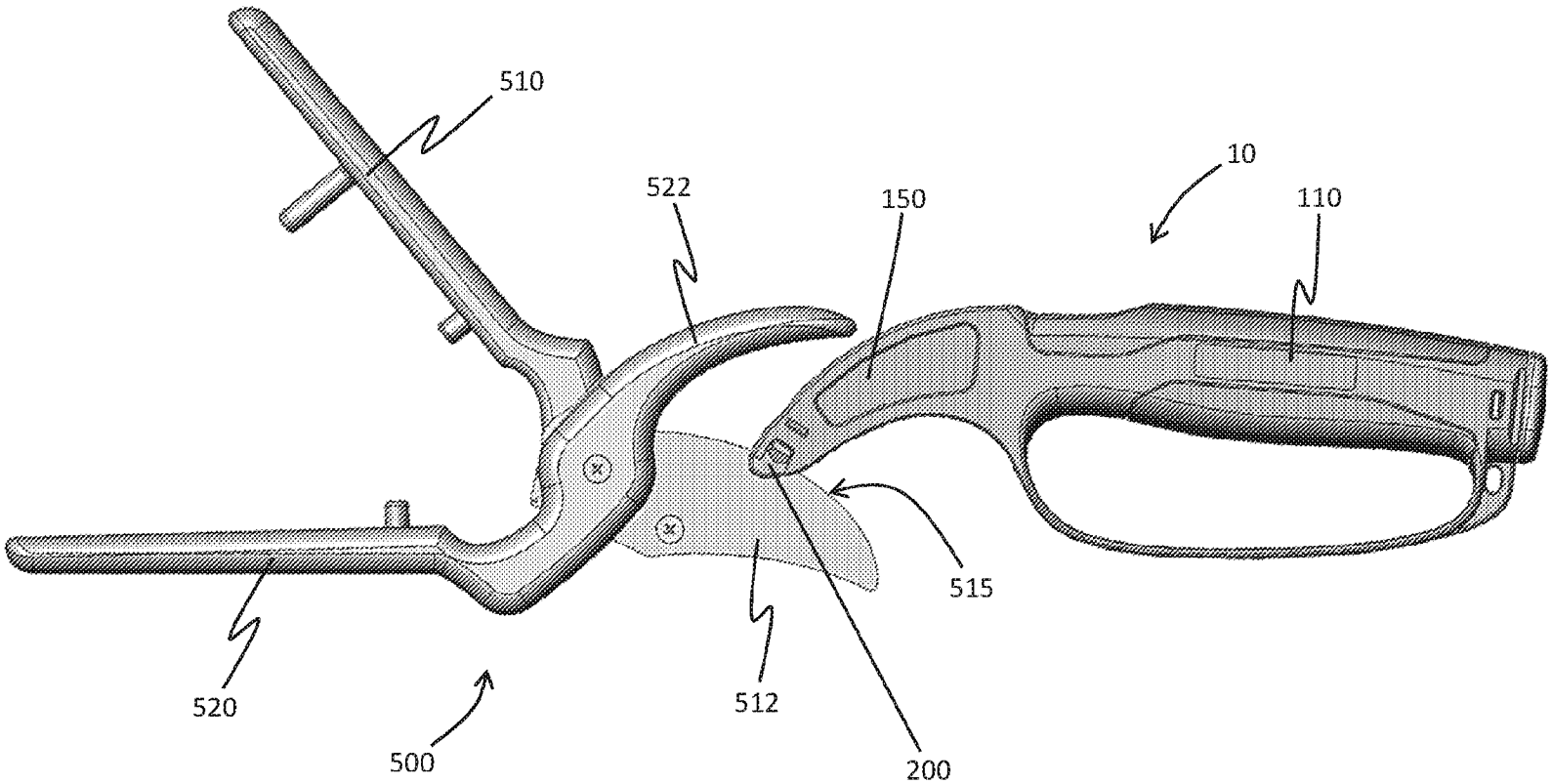
Figure 26:
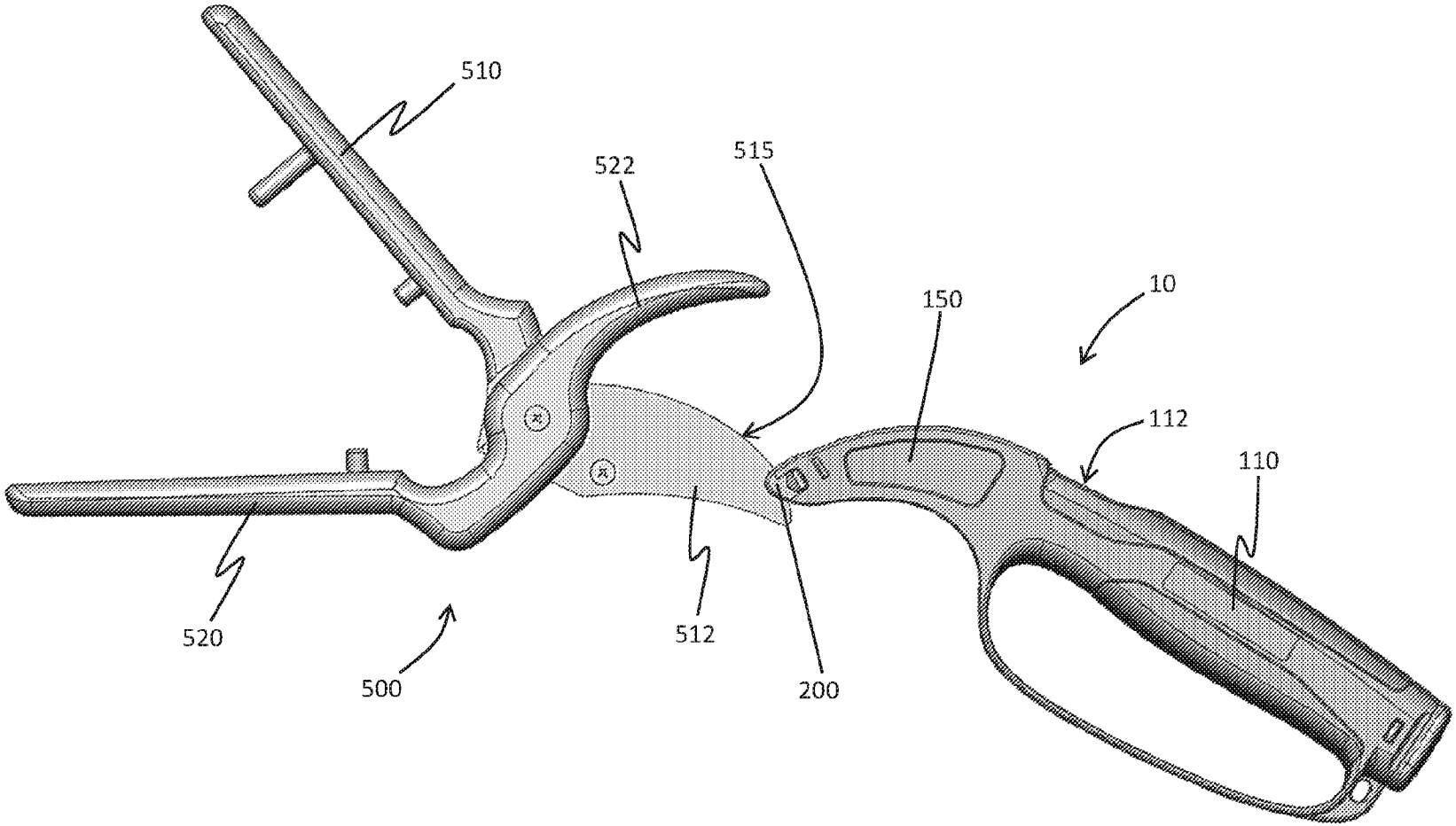
Figure 27:
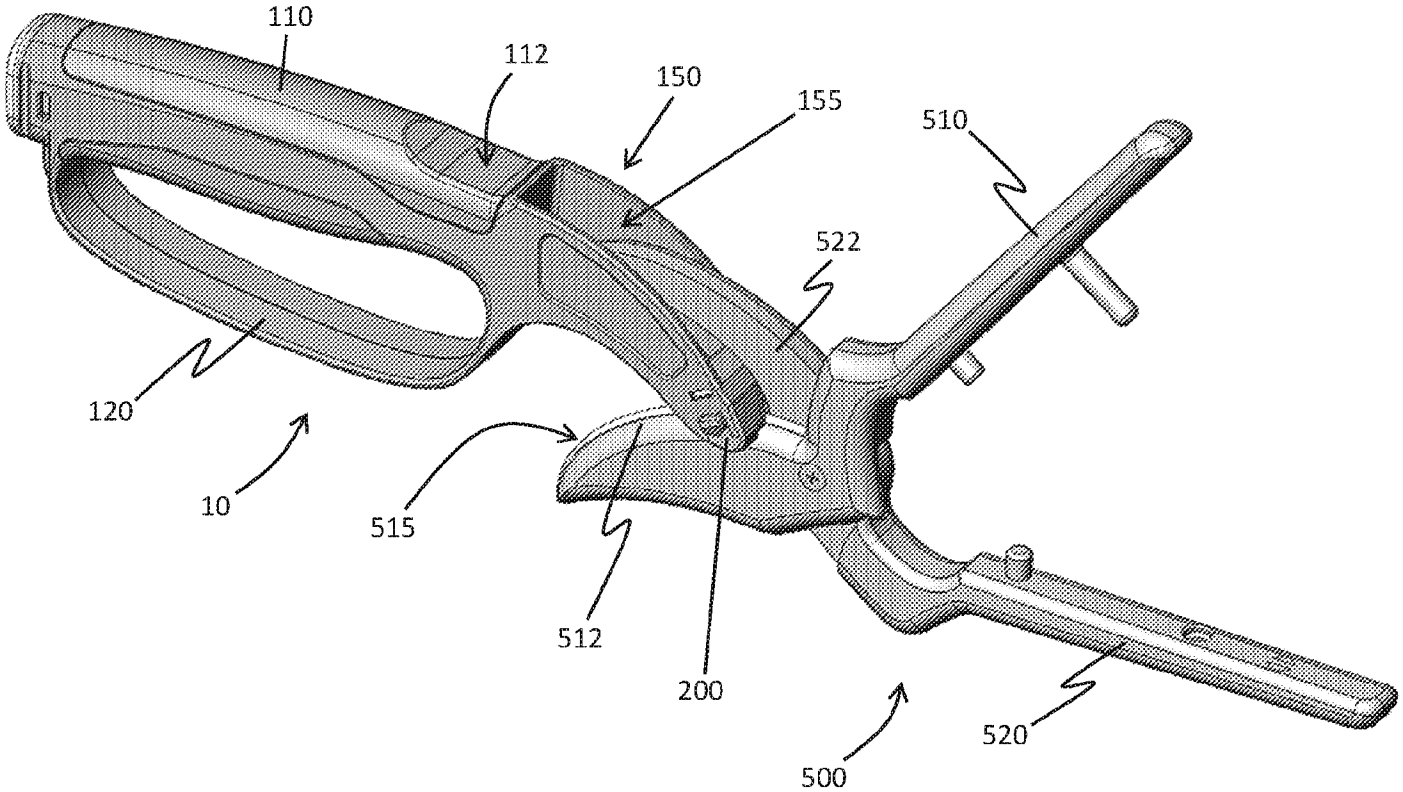
Figure 28:
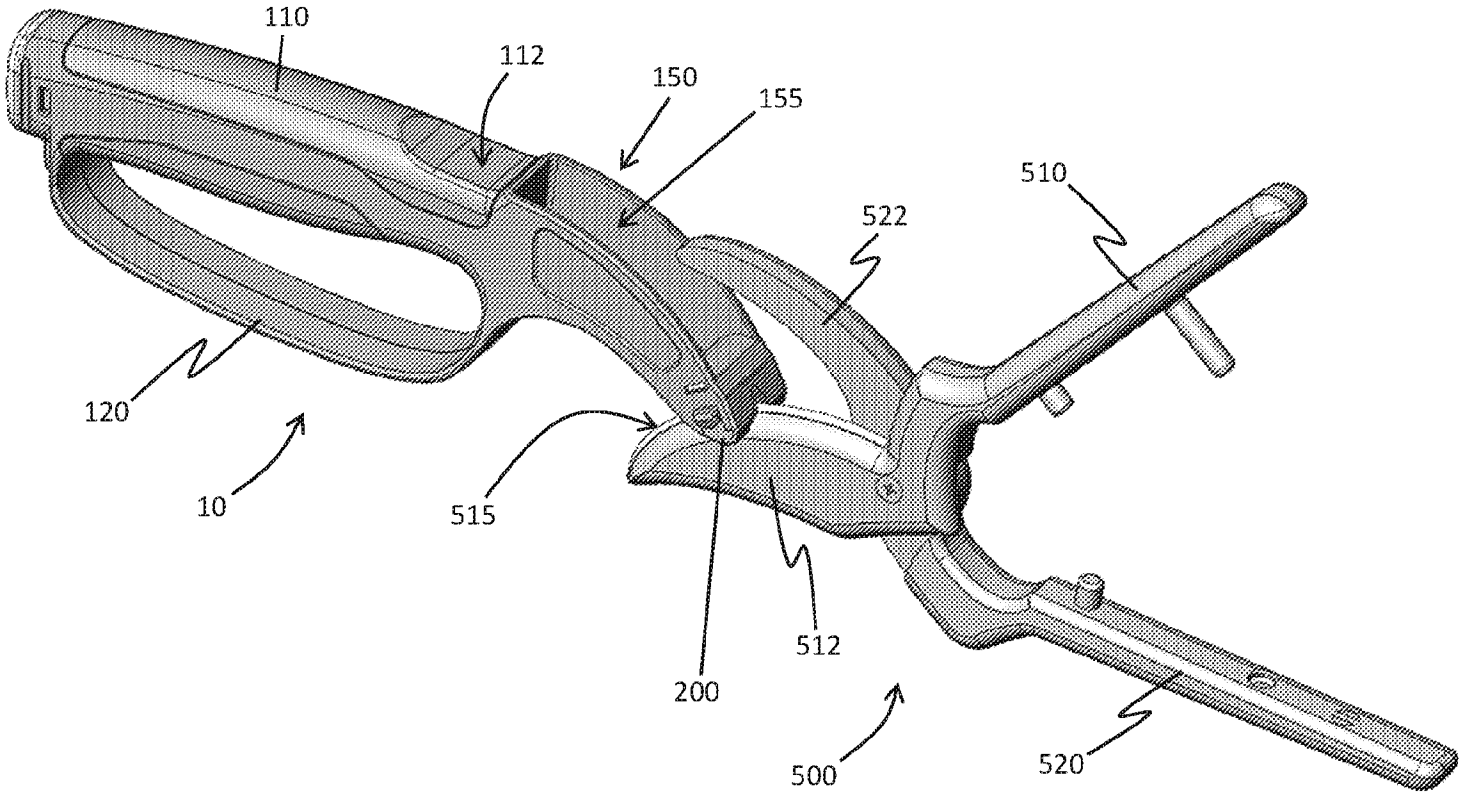
Figure 29:
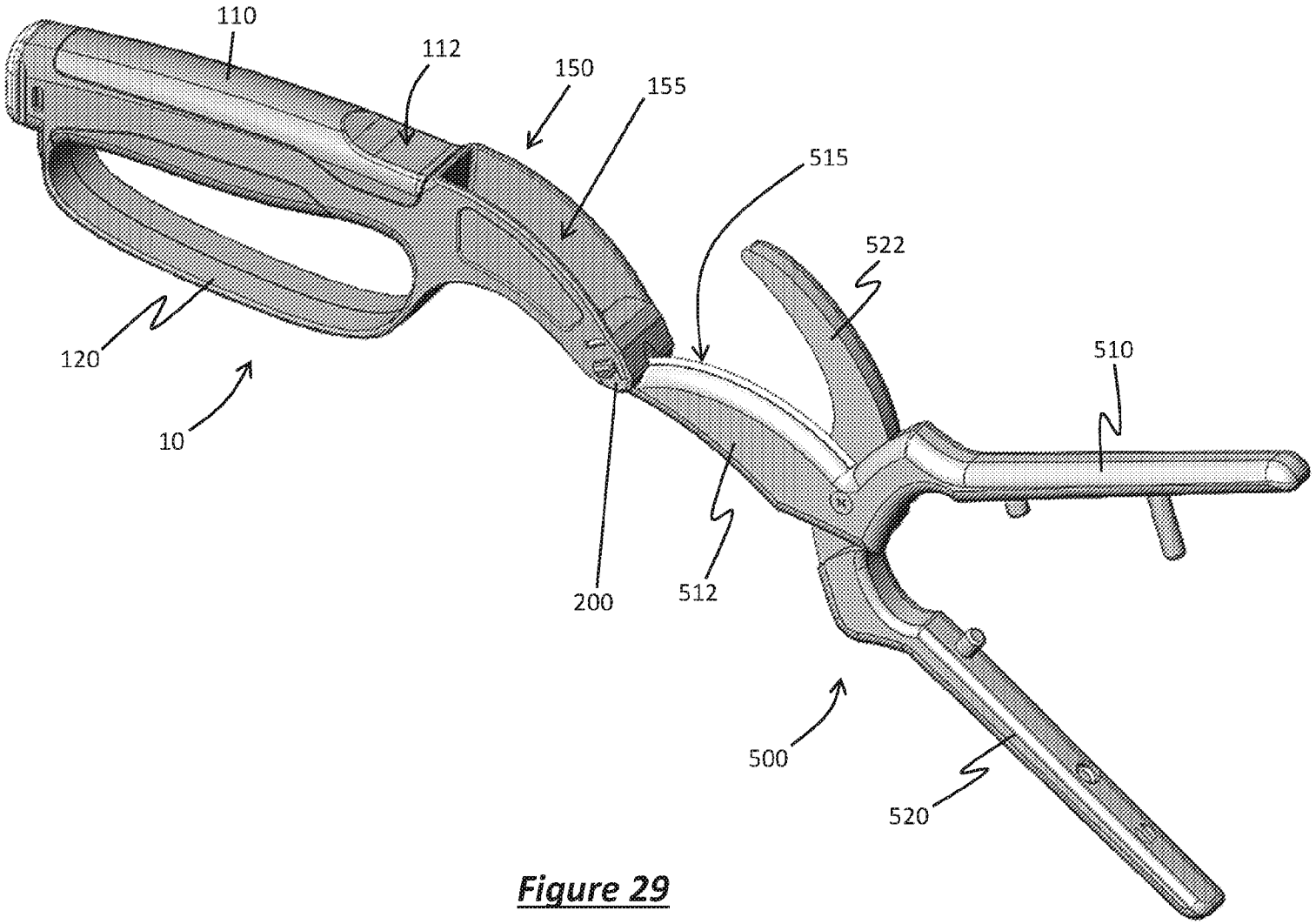
Figure 30:
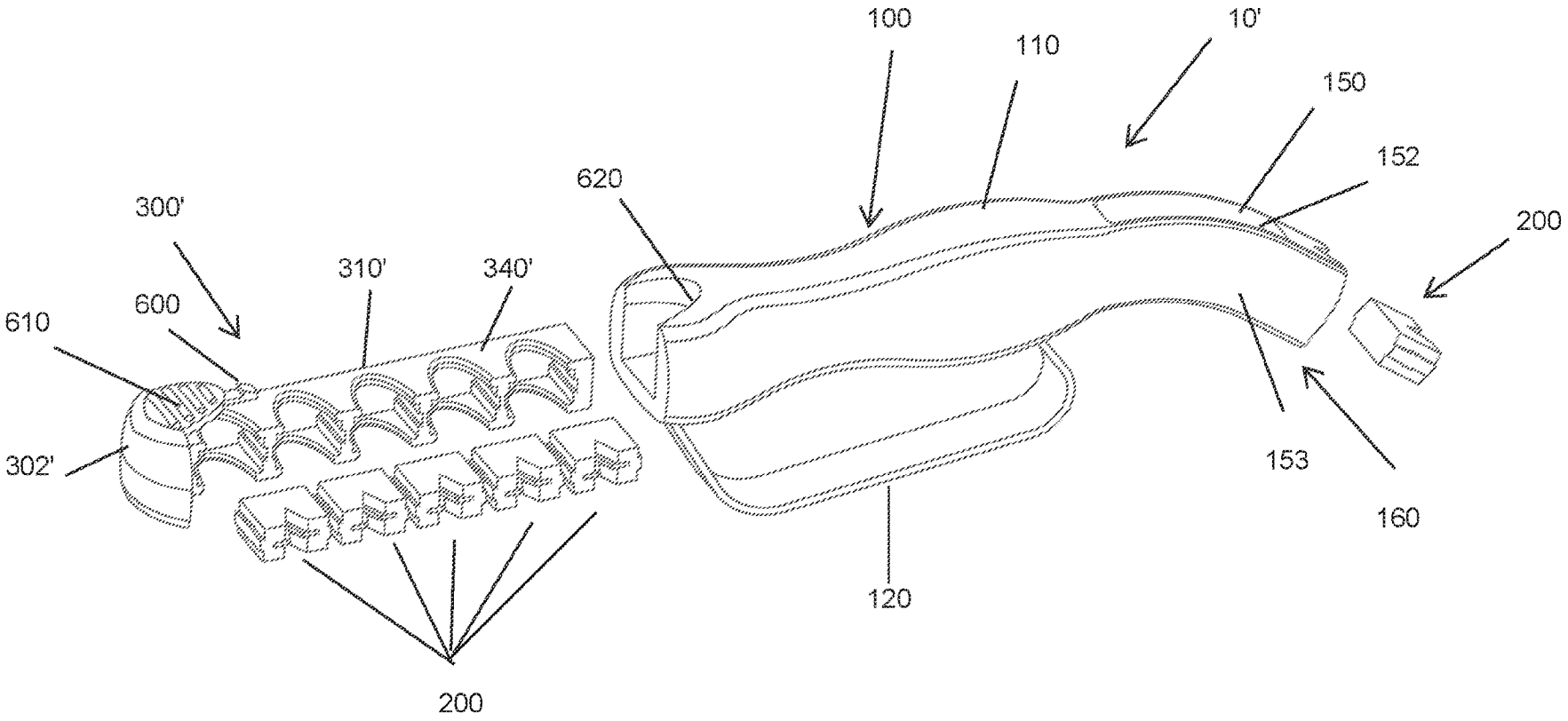

FIG. 23 a forward underside view of the sharpening element cartridge;

FIGS. 24-26 are side views illustrating use of the sharpening device on a gardening implement;

FIGS. 27-29 are perspective views illustrating use of the sharpening device on a gardening implement; and FIG. 30 is an exploded perspective view of a sharpening device according to another embodiment of the invention.

A sharpening device 10, 10' constructed according to embodiments of the present invention are illustrated in various views in the drawings and described hereinbelow.

The sharpening device 10 has a tool body 100 including a handle portion 110 with a forwardly projecting support member 150. The handle portion 110 is configured to be comfortably gripped by one hand, and has its lower surface encircled by a finger guard 120. The handle portion is elongate, with rounded and contoured upper and lower surfaces for user comfort and grip. The handle portion (or sections thereof) may comprise a "soft touch" coating, manufactured of an elastomer or other suitable polymer, for increasing user comfort and grip. The forward upper surface of the handle portion 110, adjacent connection to the support member 150, is provided with a thumb location depression 112. During use, described further below, the operator grips the handle portion 110 in one hand with fingers extending between the handle and finger guard 120 and thumb aligned with the longitudinal extent of the tool body, thumb pad resting in the depression 112.

Figure 1:
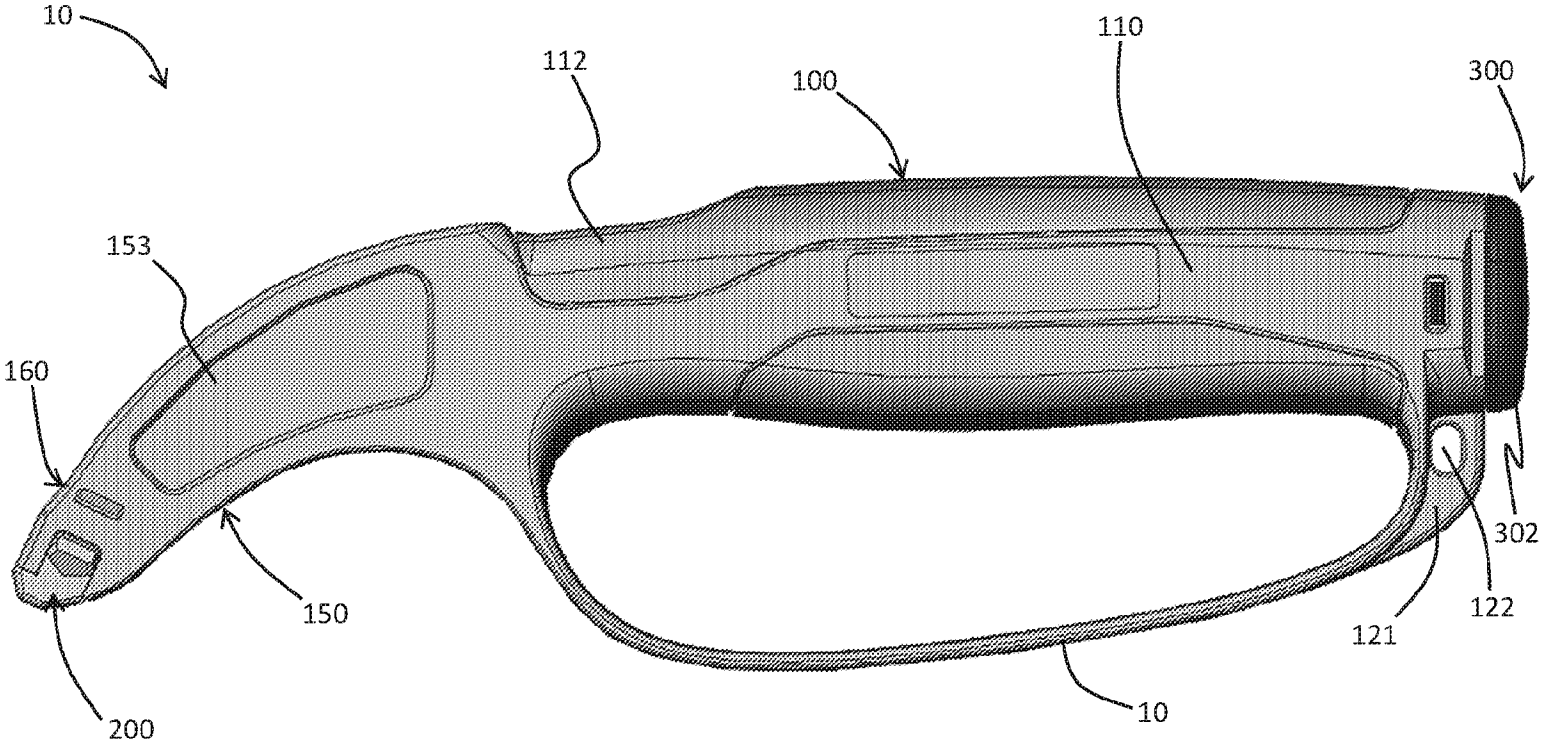
FIG. 1 is a side view of a sharpening device according to an embodiment of the invention.
Figures 2, 3:
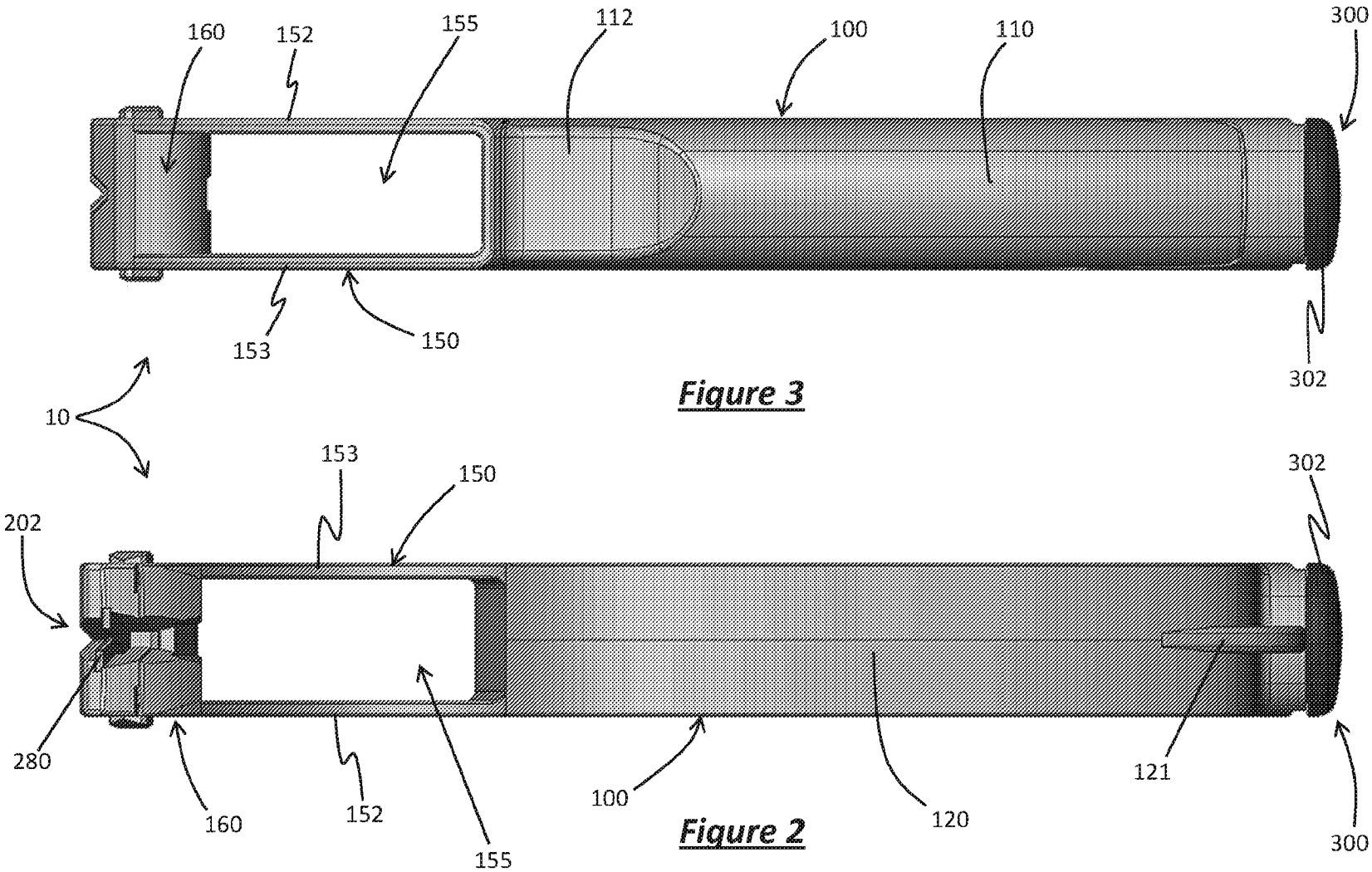
FIGS. 2 and 3 are bottom and top view of the sharpening device, respectively.
Figure 4:
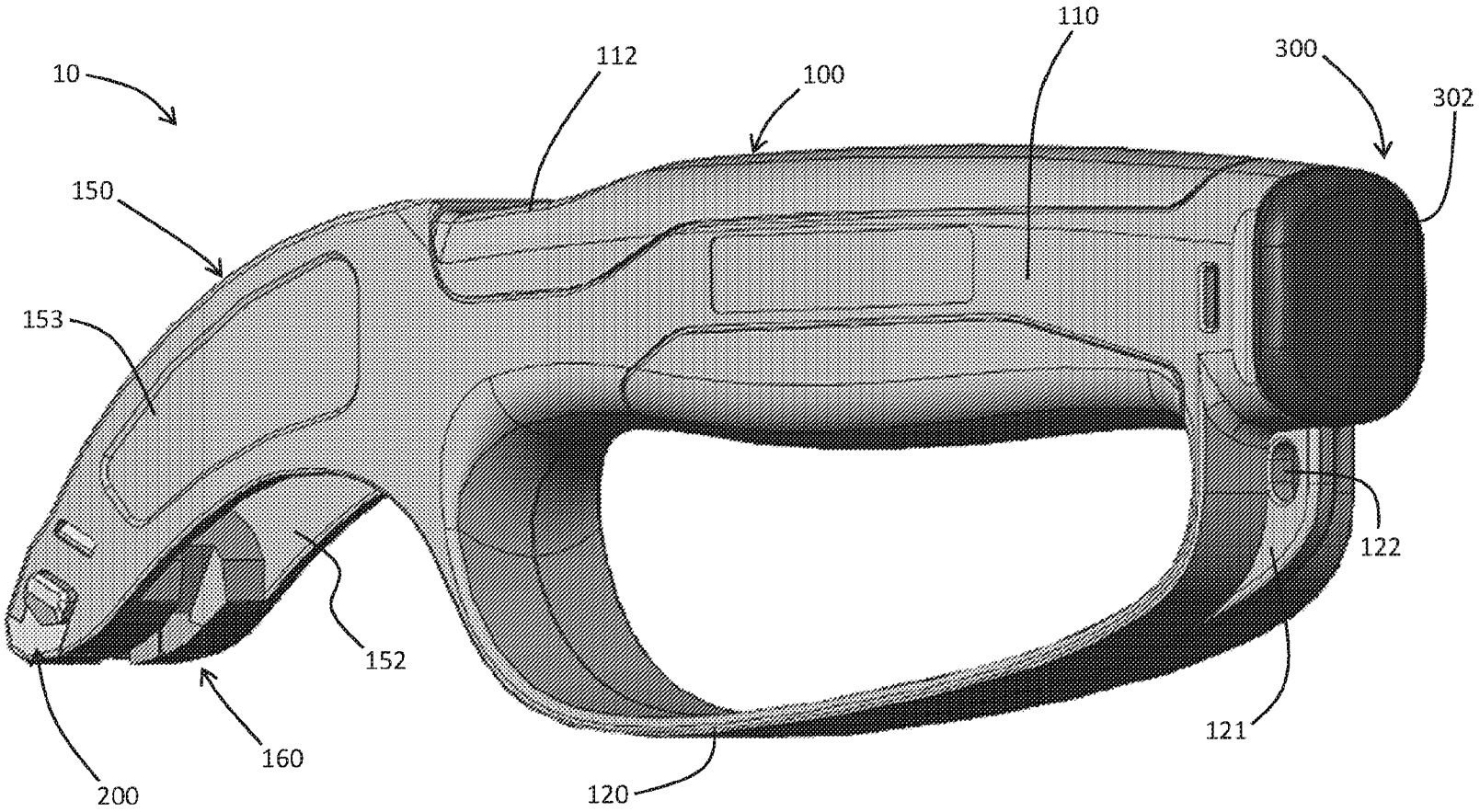
FIG. 4 is a rear side perspective view of the sharpening device.
Figure 5:
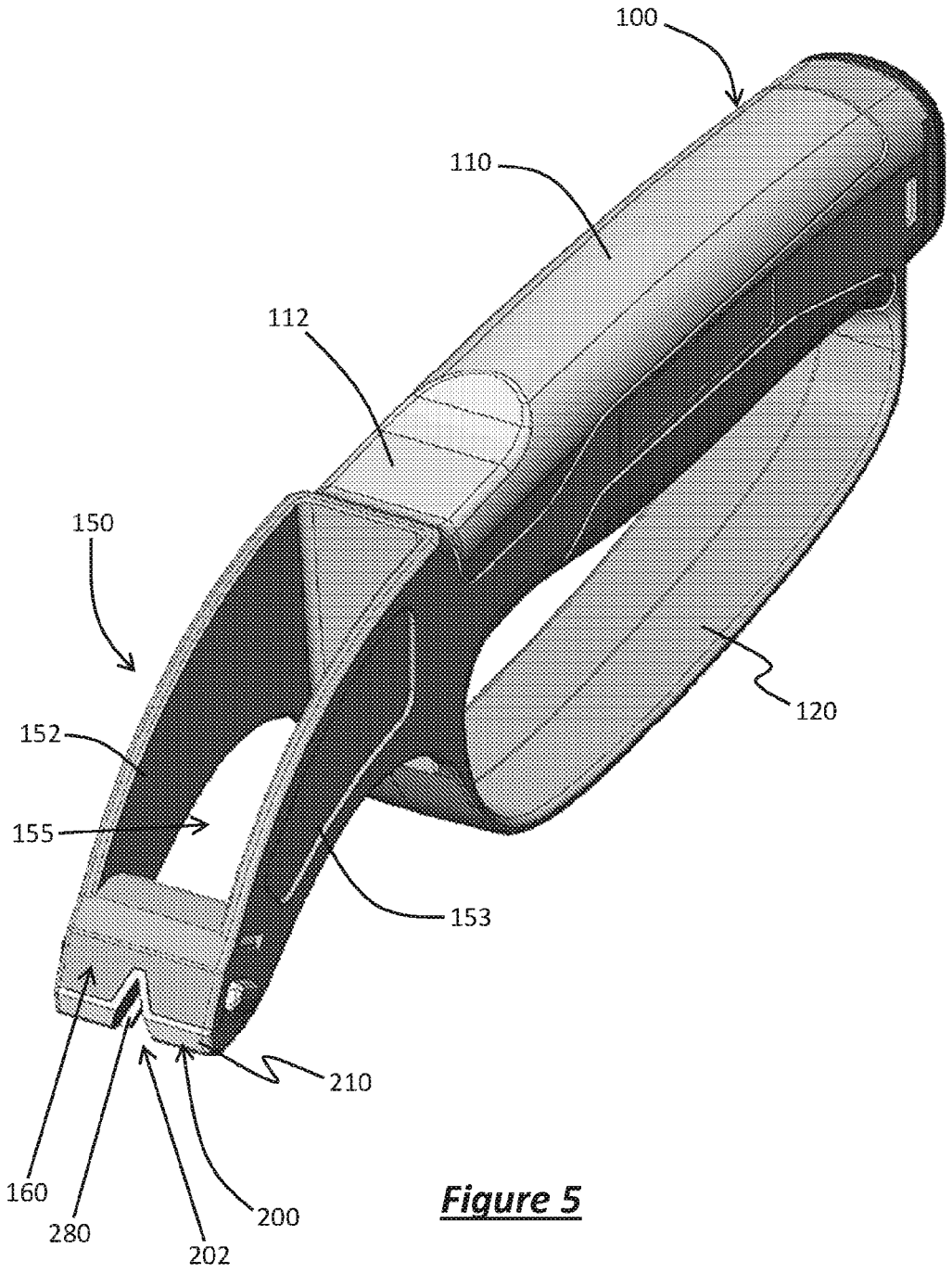
FIG. 5 is an upper front perspective view of the sharpening device.
Figure 6:
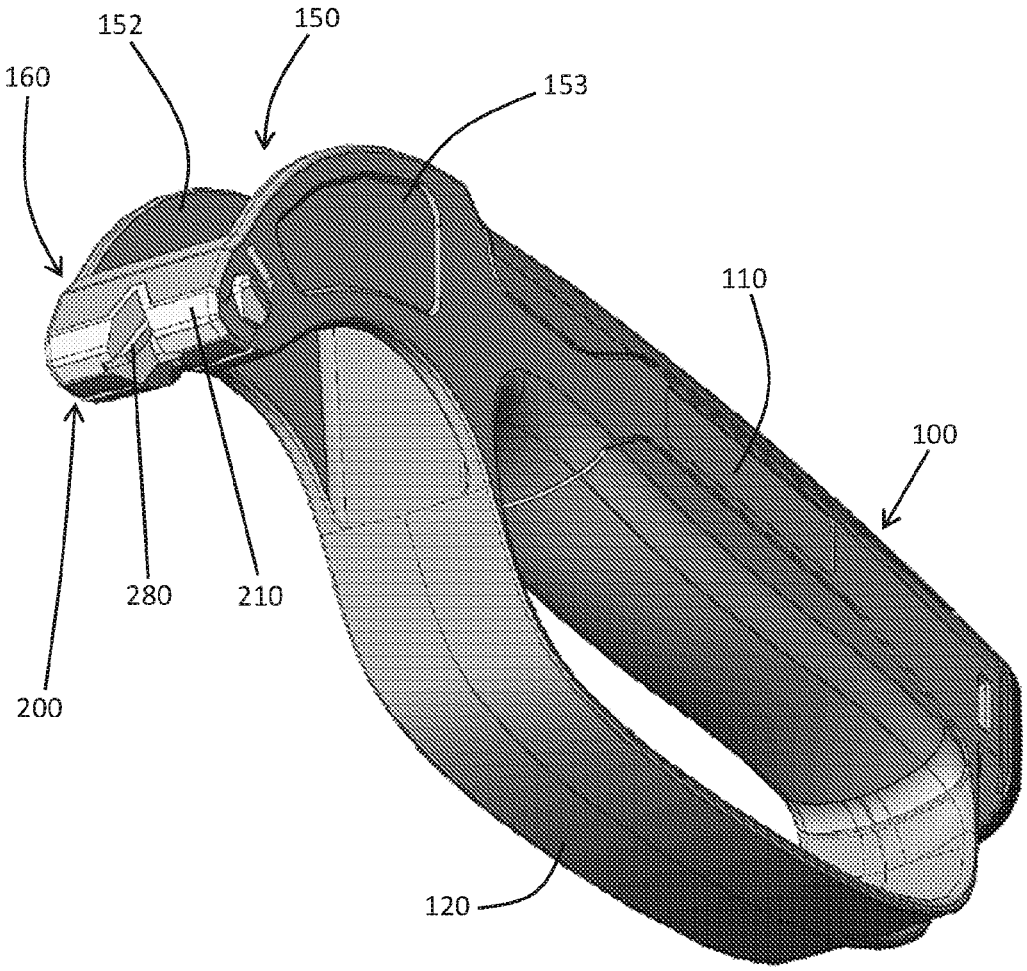
FIG. 6 is a lower front perspective view of the sharpening device.
Figure 7:
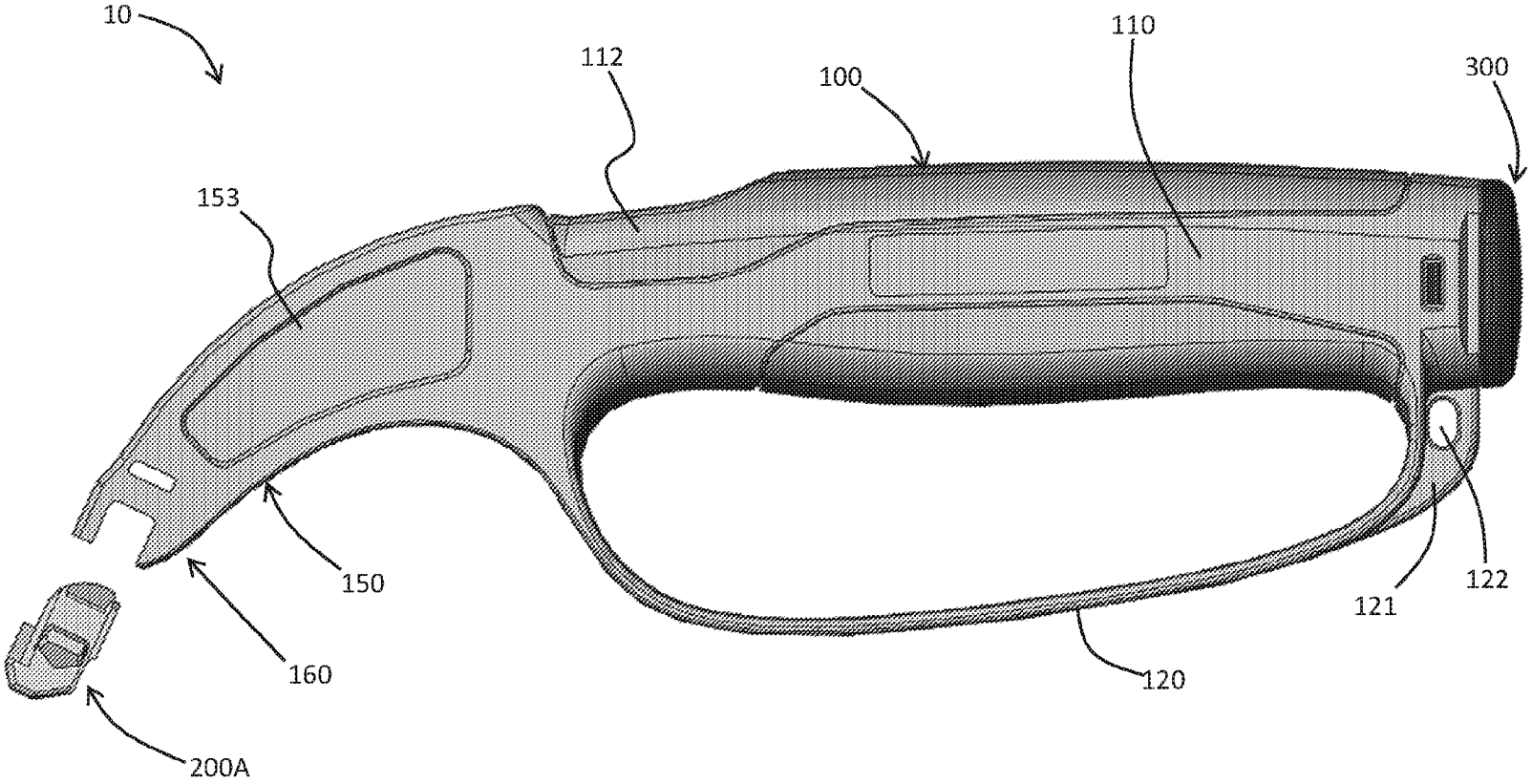
FIG. 7 is a side view of the sharpening device with sharpening element cartridge detached.
Figure 8:
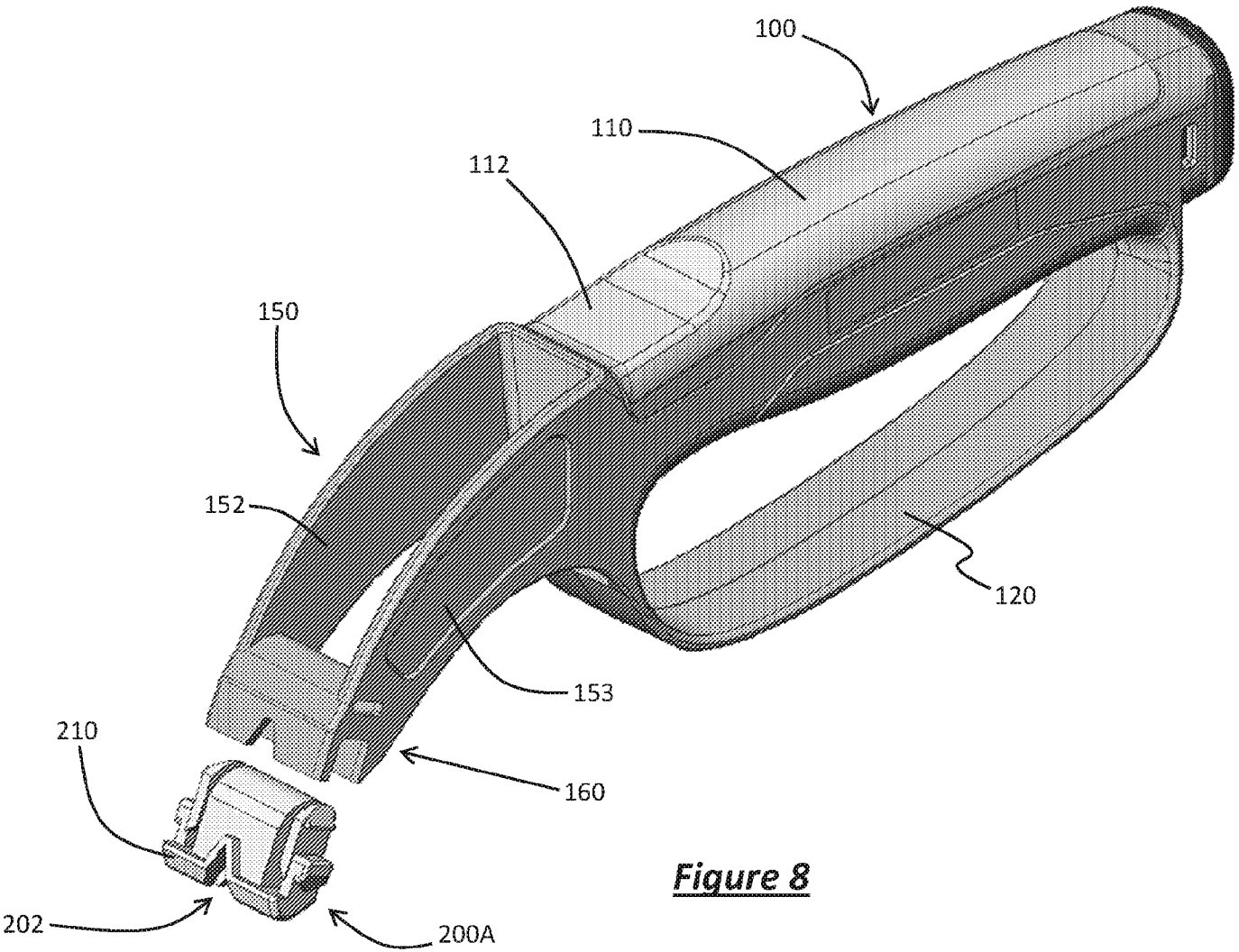
FIG. 8 is an upper front perspective view of the sharpening device with sharpening element cartridge detached.
Figure 9:
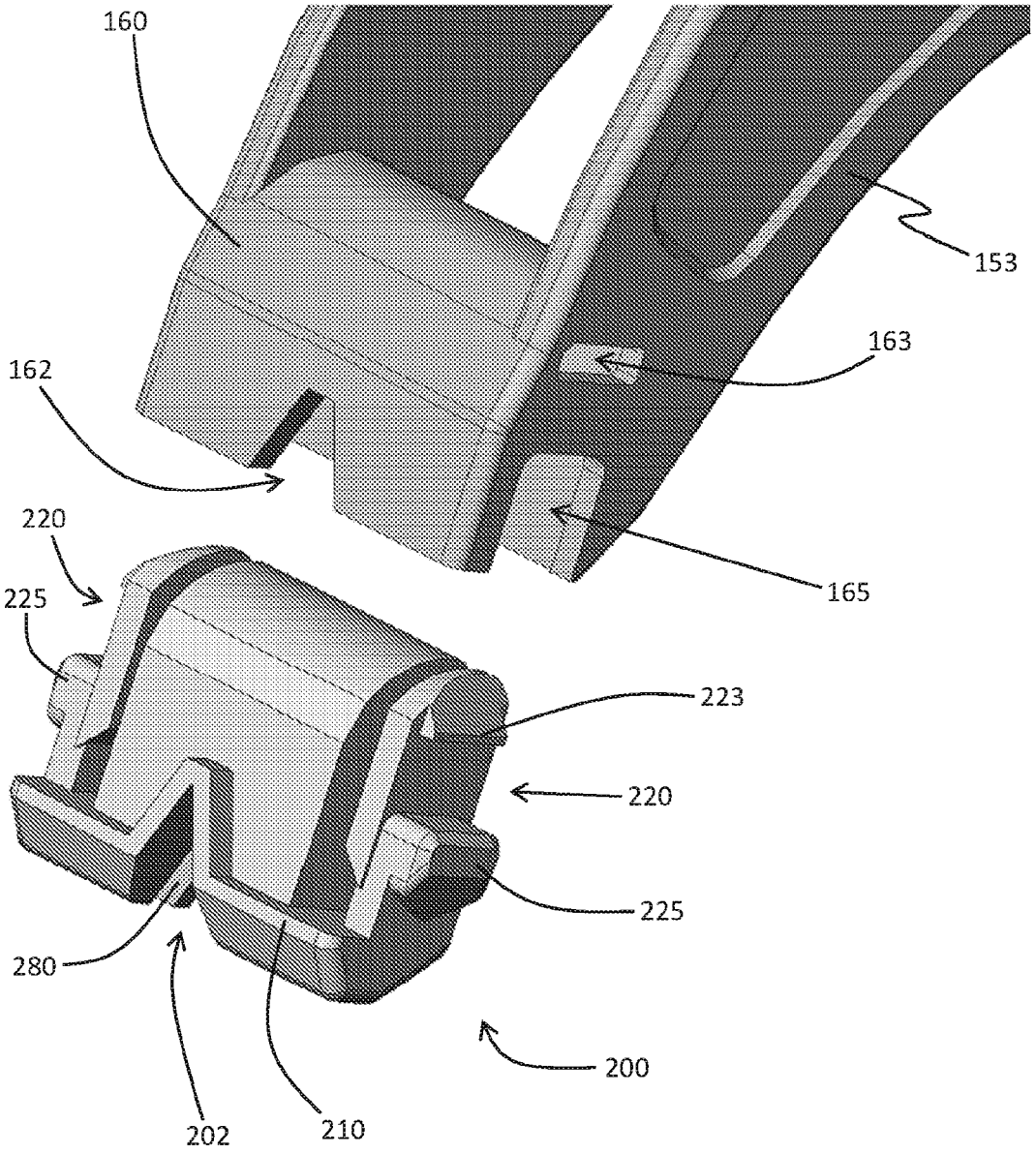
FIG. 9 is an enlarged front perspective view of the sharpening device with sharpening element cartridge detached.
Figure 10:
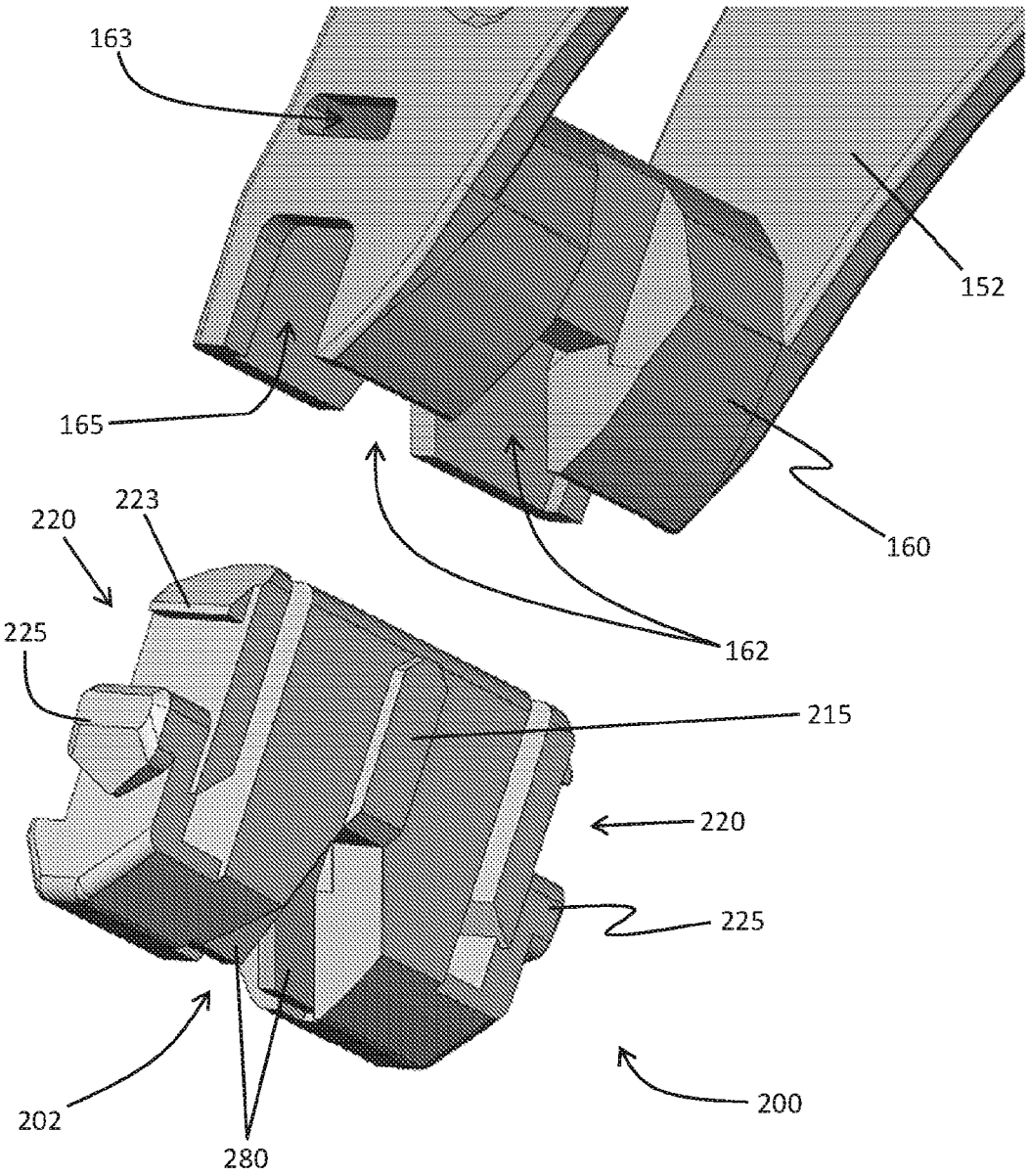
FIG. 10 is an enlarged rear perspective view of the sharpening device with sharpening element cartridge detached.
Figure 11:
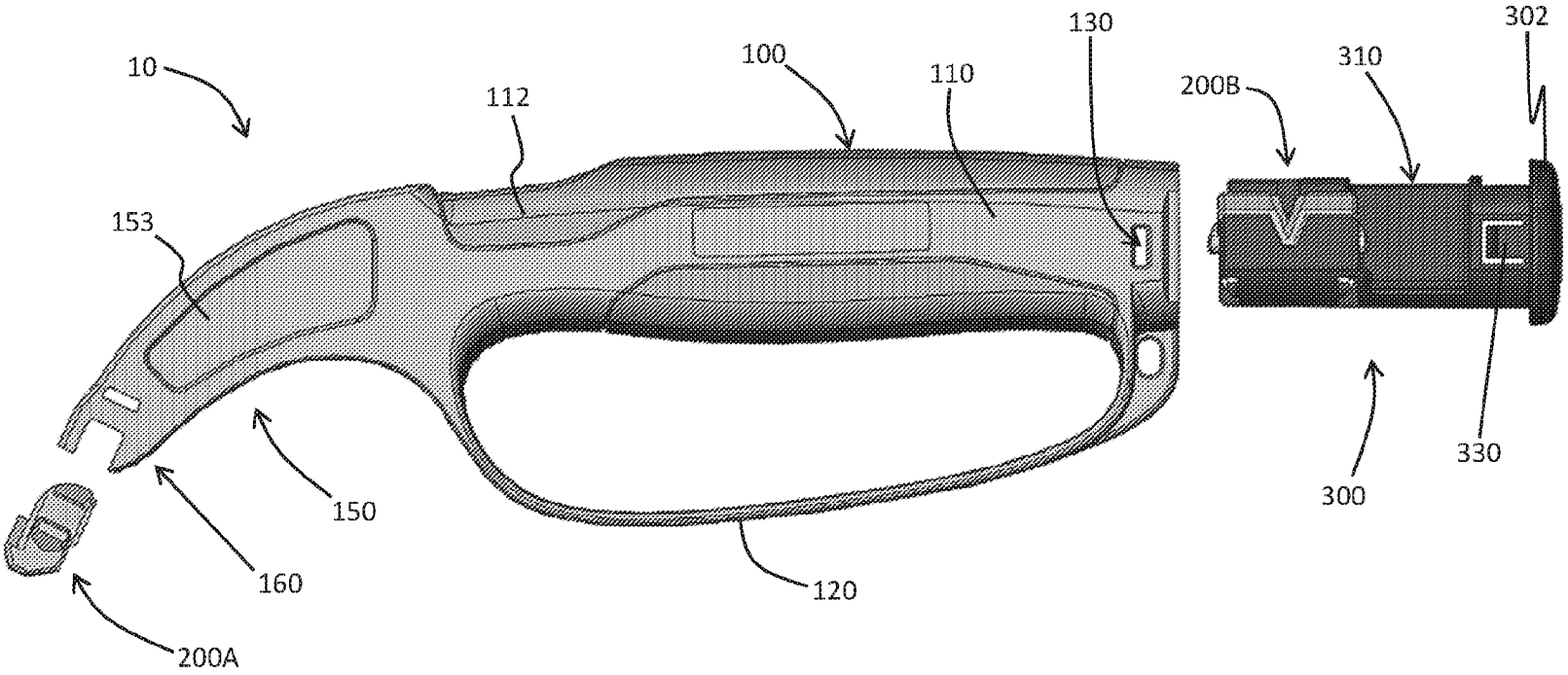
FIG. 11 is a side view of the sharpening device with sharpening element cartridge and storage carriage detached.

The support member 150 projects forwardly from the handle portion and, from a side view such as seem in FIG. 1, is curved downward and tapers in to a cartridge support housing 160 provided at the end thereof. The cartridge support housing 160 has a receptacle configured to receive a sharpening element cartridge 200. The support member is formed from right and left support arms 152, 153 that are generally flat, plate-like structures parallel to the sides of the handle portion 110. The right and left support arms 152, 153 are attached to the front of the handle portion 110 and joined at their forward end by the cartridge support housing 160, providing an aperture 155 therebetween, seen best in FIGS. 2, 3 and 5.

At the rear of the sharpening device 10, the tool body 100 contains a storage carriage 300, described in detail hereinbelow. The storage carriage 300 has a butt portion 302 that forms the rear of the device 10 when in place. Below the storage carriage location the tool body is provided with a web 121 extending between the handle portion 110 and the finger guard 112. The web 121 has a hole 122 therein which allows for attachment of a cord or the like for hanging or otherwise securing the device 10.

When fitted in the receptacle of the cartridge support housing 160, the sharpening element cartridge 200 forms the forward end of the sharpening device 10, which is angled down by about sixty degrees or so by virtue of the support member 150 being curved downwardly. The sharpening element cartridge 200 has a flange 210 with a forward tapered edge, the surface of the flange 210 being substantially flush with the surface of the cartridge support housing 160 where they meet. The flange 210 has a generally V-shaped slot 202 centrally formed therein, the direction of the slot 202 being parallel to the longitudinal extent of the tool body 100. The cartridge 200 is fitted with sharpening elements 280 firmly secured therein, portions of which extend into the slot 202.

When in use the sharpening element cartridge 200 is secured in the receptacle defined by the cartridge support housing 160. However as seen in the drawings, for example FIGS. 7 to 10, the sharpening element cartridge 200 is able to be detached and removed from the tool body 100. This is enabled by latch arms 220 provided on the sides of the cartridge 200, attached to the cartridge at the front thereof and extending parallel to the sides of the cartridge, separated from the cartridge body 205 by a gap 206. The latch arms 220 each have a respective latch formation at the end thereof, comprising a sloped surface 222 leading to a ledge 223. Intermediately located on each latch arm 220 is a respective release button 225 protruding outwardly to the side. When the sharpening element cartridge is received in the support housing receptacle, the latch formations are located in apertures 163 on the sides of the support housing and the release buttons 225 are received in slots 165, which arrangement holds the cartridge in place. To remove the sharpening element cartridge from the device, the user presses inwardly on the release buttons 225 which causes the latch arms to flex inwardly so that the ledges 223 clear the apertures 163. This permits the sharpening element cartridge 200 to be slid out of the support housing. Location of the sharpening element cartridge 200 in the cartridge support housing is further assisted by a ridge 215 formed on the rear of the cartridge, which slides into a corresponding groove inside the support housing receptacle (not seen in the drawings).

The primary purpose of configuring the sharpening element cartridge 200 so that it may be removed from the cartridge support housing 160 is to allow for a different cartridge to be installed in replacement. This permits the sharpening device 10 to be selectively fitted with one of a variety of cartridges, for example a cartridge (200A) adapted for sharpening an anvil-type blade or a cartridge (200B) adapted for sharpening a bypass-type blade. The two different sharpening element cartridges 200A, 200B may be supplied with the device, and the cartridge not in use can be stored within the tool body 100, as explained below.

Figure 12:
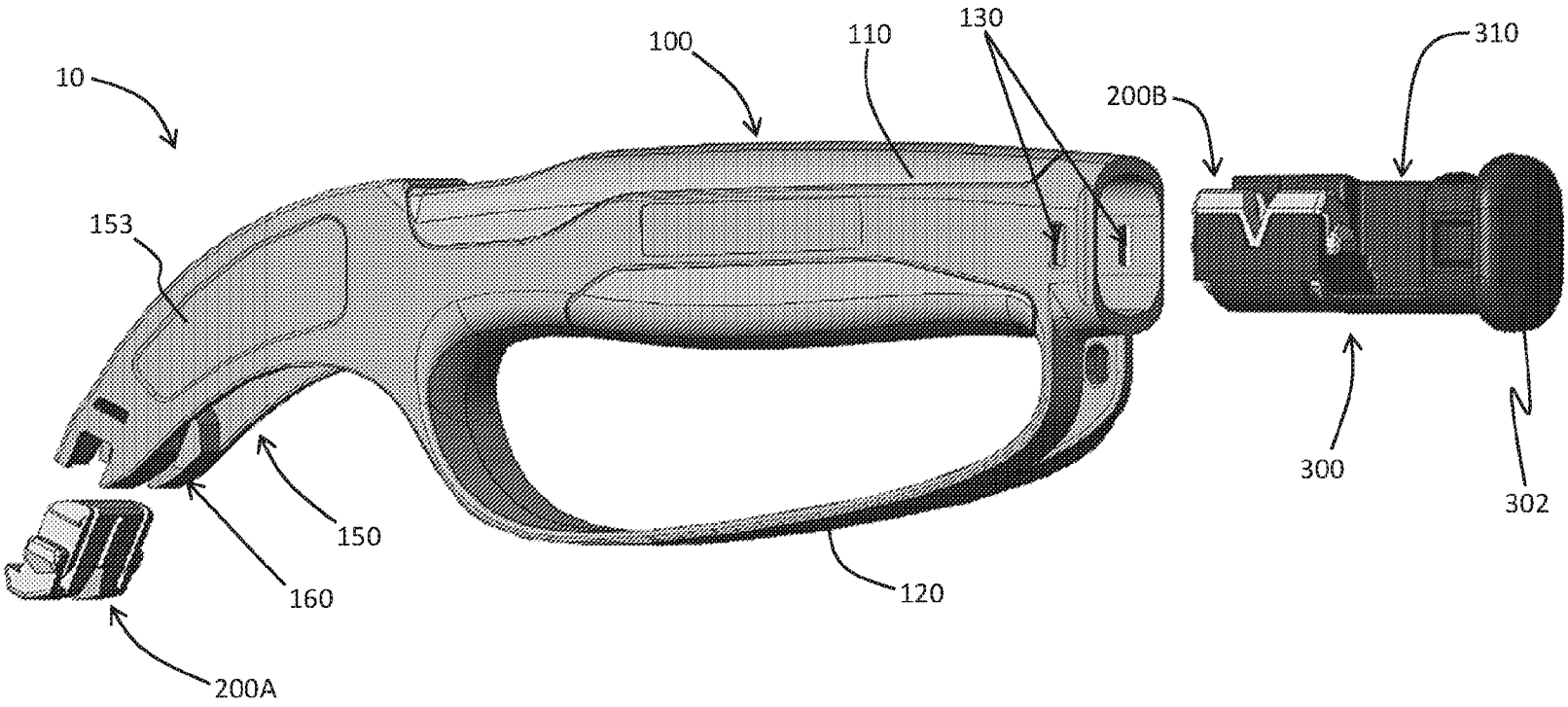
FIG. 12 is a rear side perspective view of the sharpening device with sharpening element cartridge and storage carriage detached.
Figure 13:
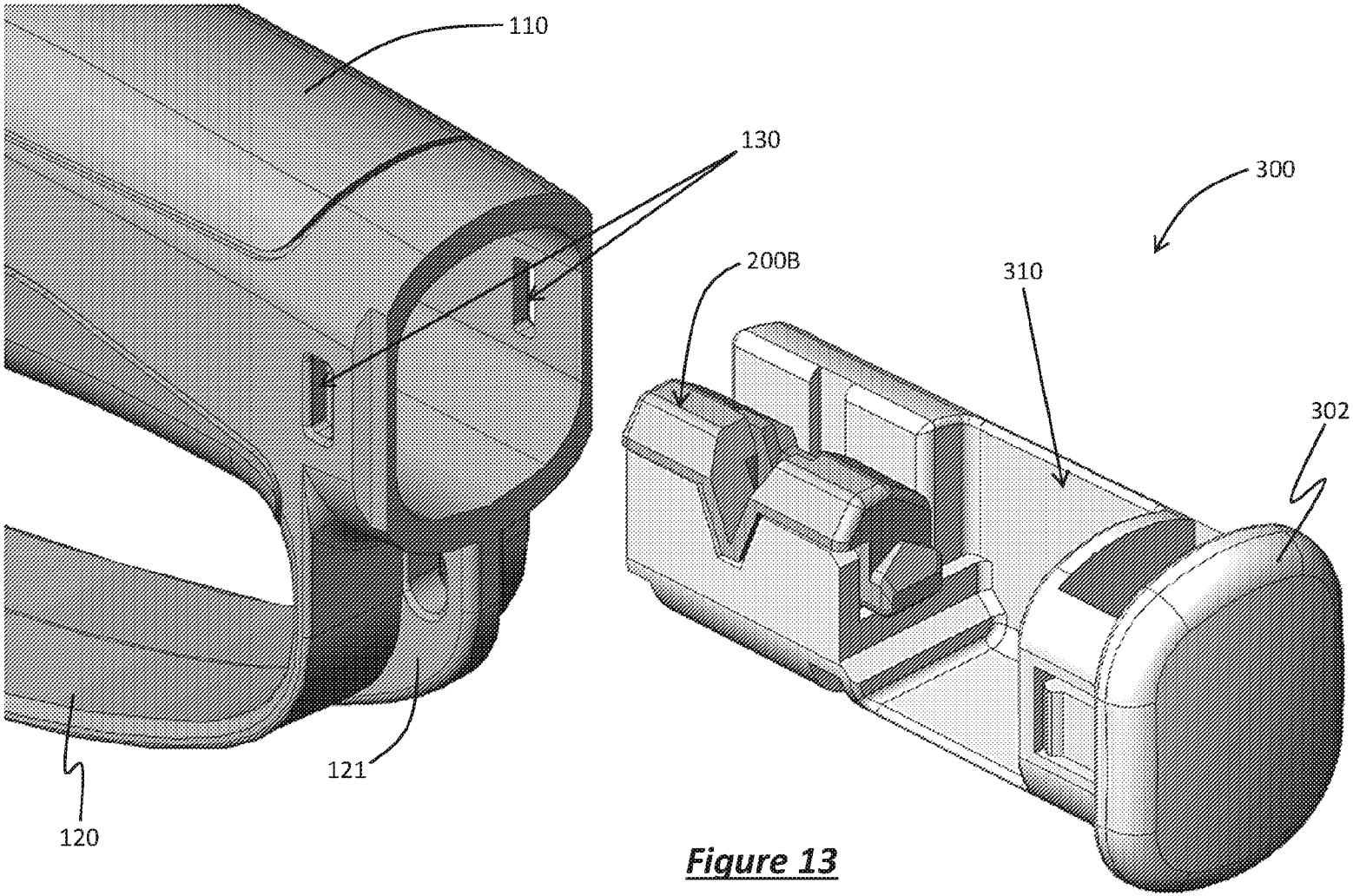
FIG. 13 is an enlarged rear perspective view of a portion of the sharpening device with storage carriage removed.
Figure 14:
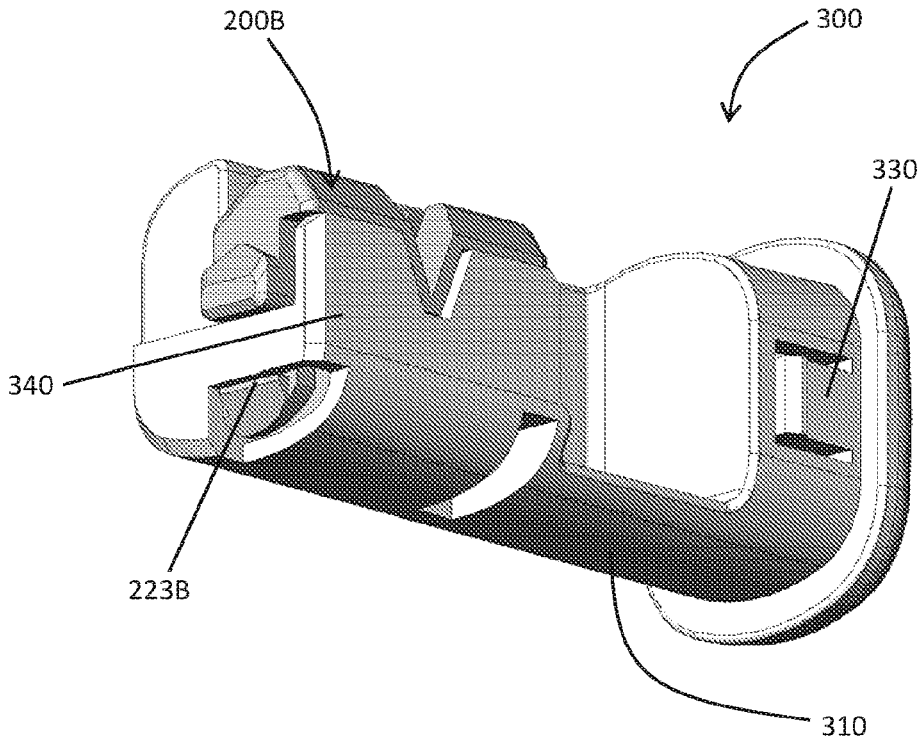
FIG. 14 is a forward perspective view of the storage carriage fitted with a sharpening element cartridge.
Figure 15:
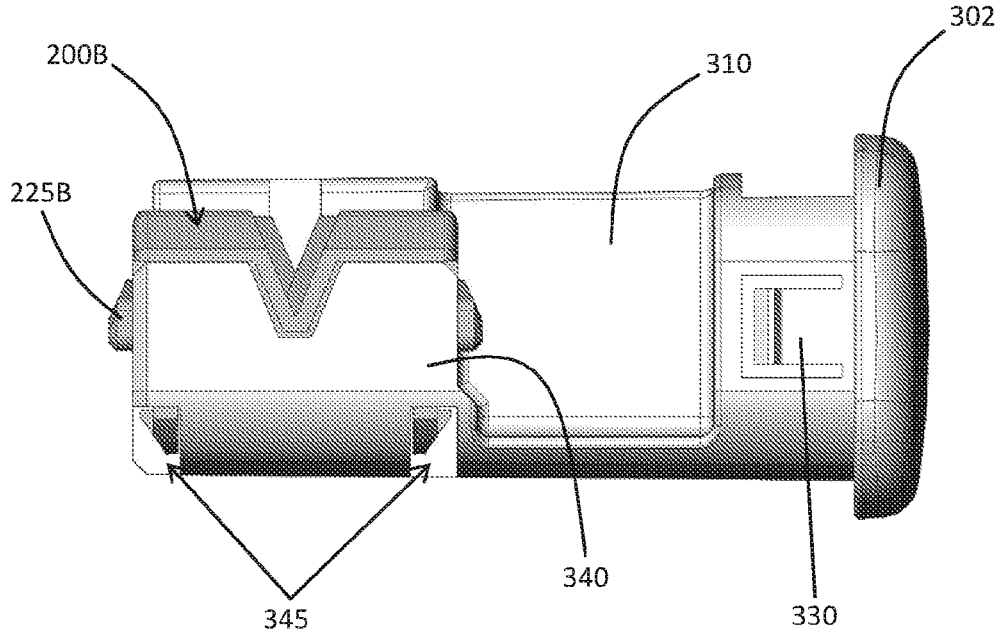
FIG. 15 is a front side view of the storage carriage fitted with a sharpening element cartridge.
Figure 16:
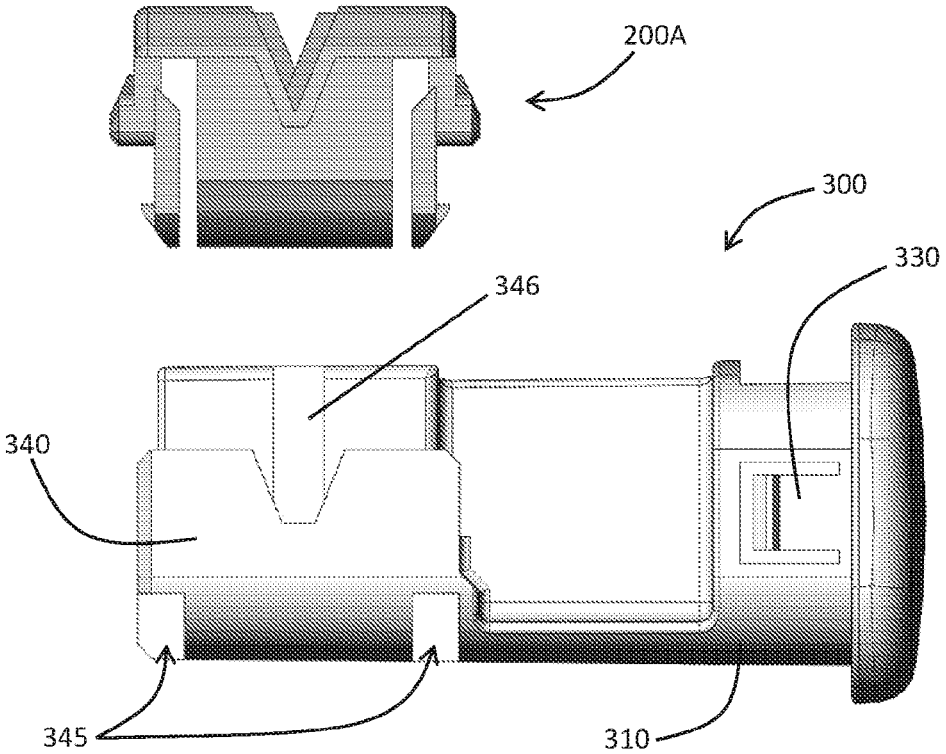
FIG. 16 is a front side view of the storage carriage with sharpening element cartridge detached.
Figure 17:
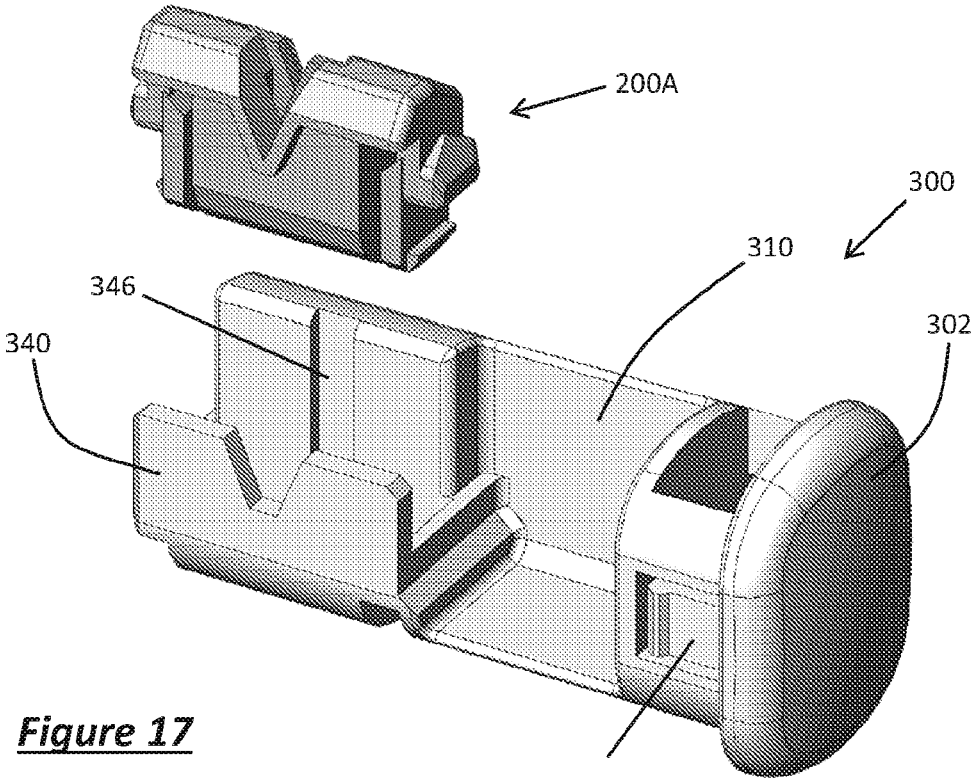
FIG. 17 is a rearward perspective view of the storage carriage with sharpening element cartridge detached.
Figure 18:
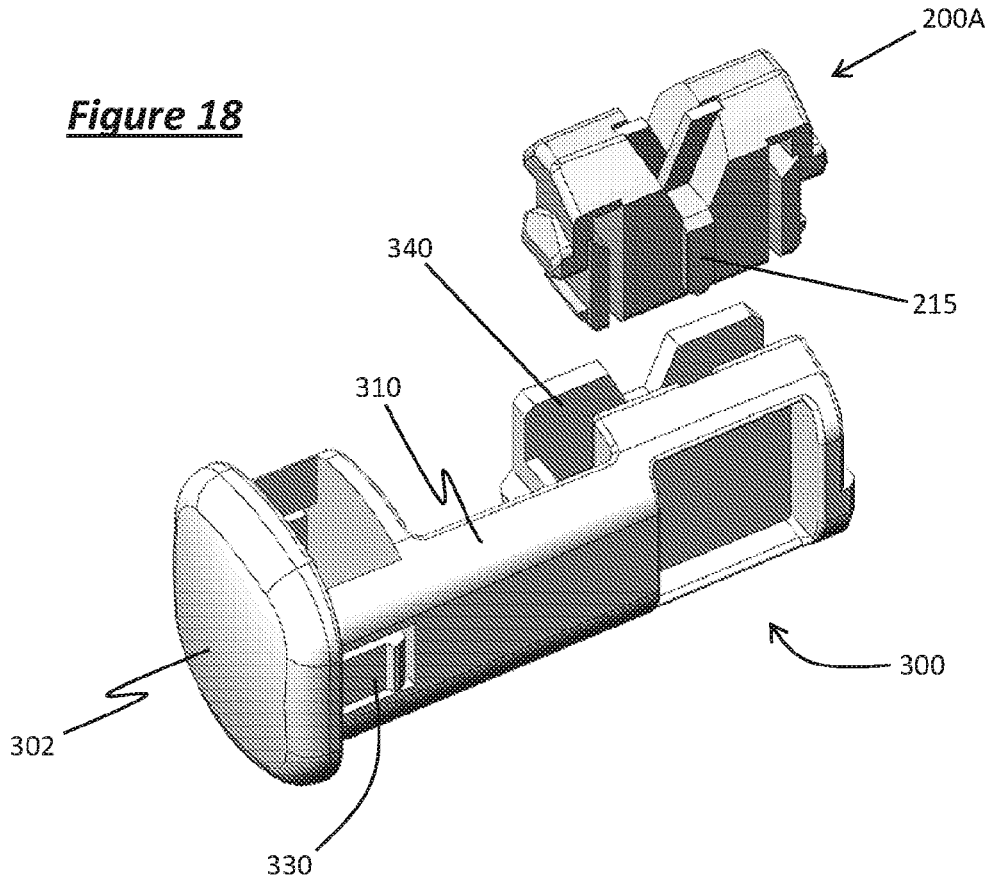
FIG. 18 is an upper rear side perspective view of the storage carriage with sharpening element cartridge detached.
Figure 19:
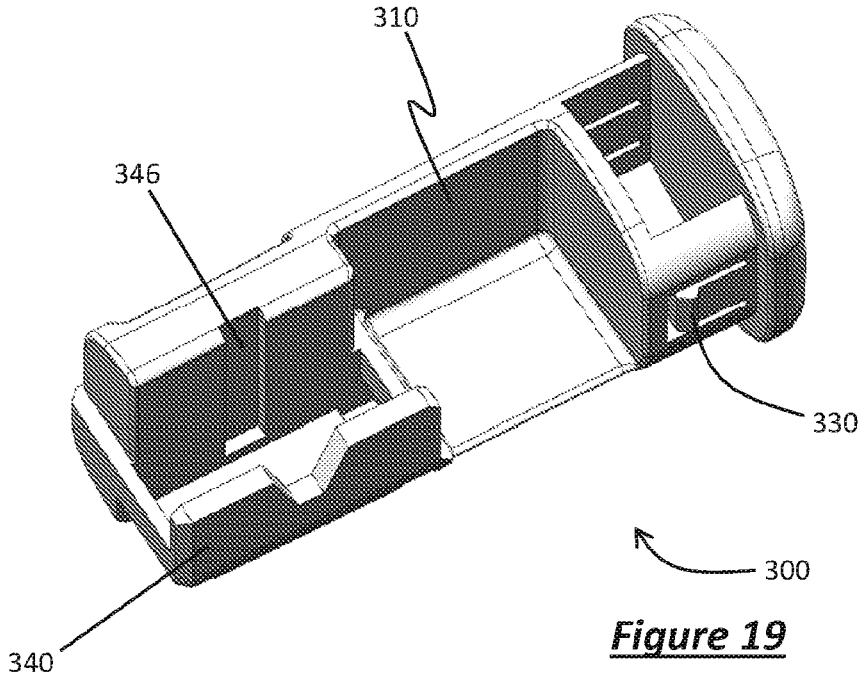
FIG. 19 is an upper rear side perspective view of the storage carriage in isolation.
Figure 20:
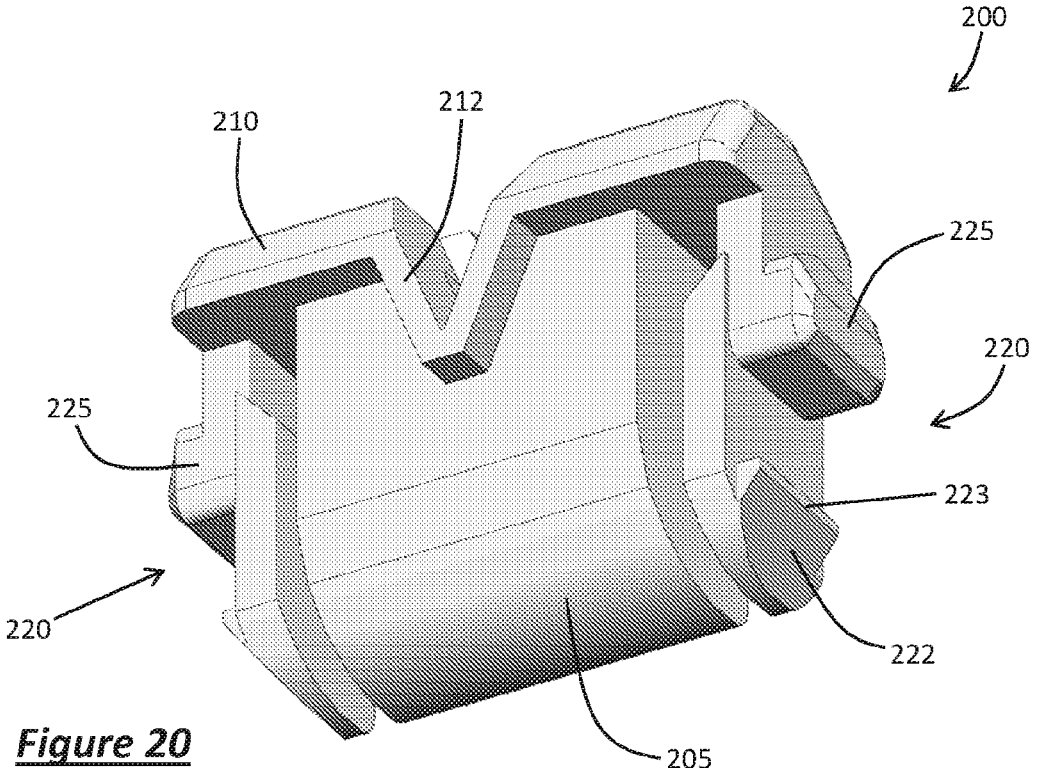
FIG. 20 is a rearward perspective view of a sharpening element cartridge.
Figure 21:
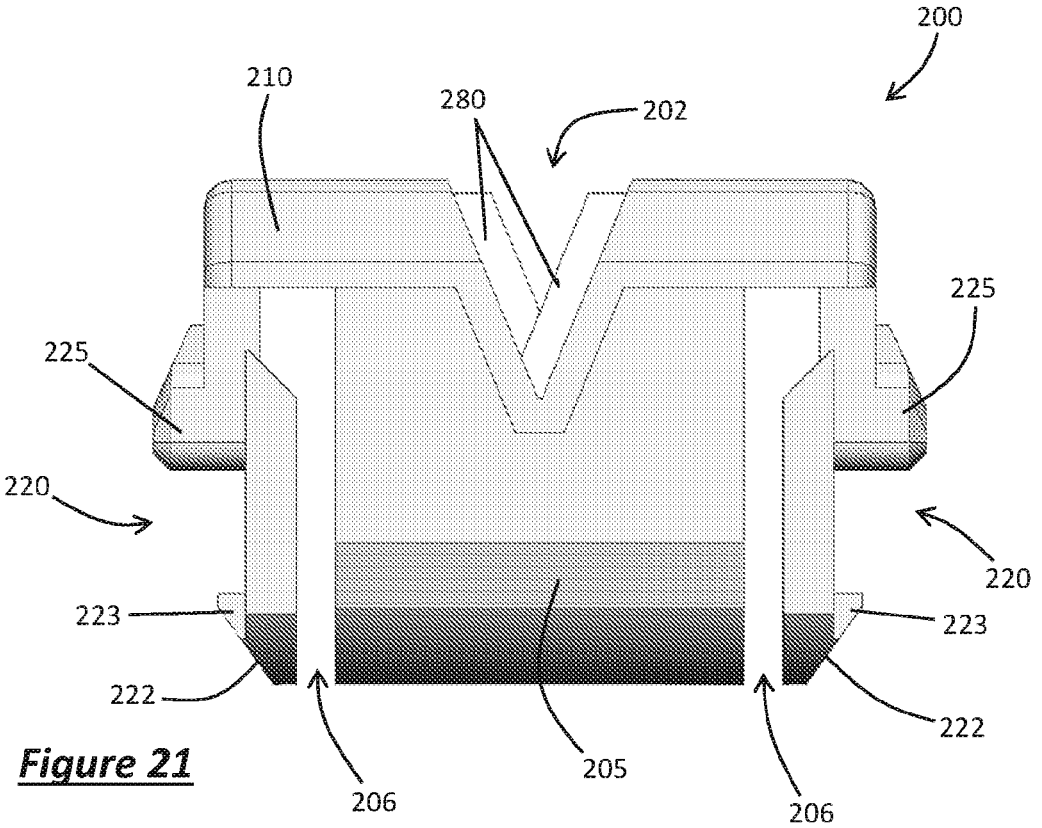
FIG. 21 is a top view of the sharpening element cartridge.
Figure 22:
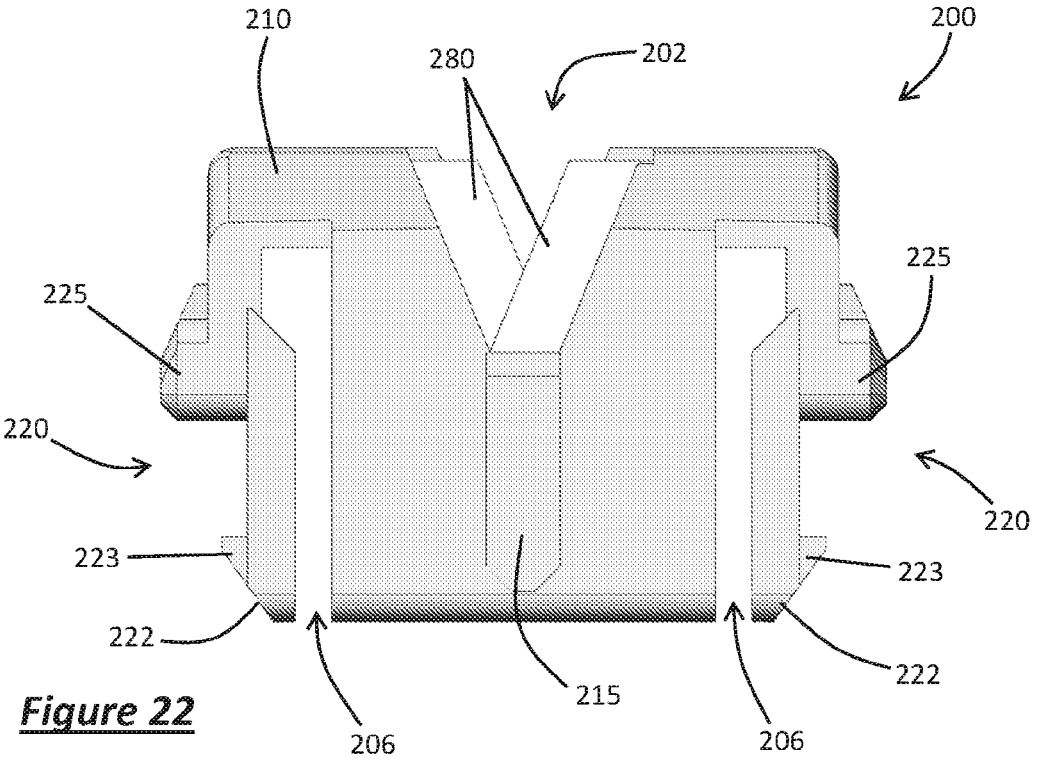
FIG. 22 is a bottom view of the sharpening element cartridge.

As seen best in FIGS. 12 and 13, the handle portion 110 of the device has a hollow barrel that is open to the rear. The storage carriage 300 is adapted to fit within the hollow barrel at the rear of the tool body, and is also configured to hold the sharpening element cartridge that is not operatively fitted to front of the device at a given time.

The storage carriage 300 has an elongate body 310 attached to the butt portion 302. The carriage body 310 has an external profile of a size and shape adapted to fit relatively closely inside the hollow barrel of the tool body handle portion 110. The forward portion of the carriage body is formed with a wall structure 340 open to one direction, the wall structure being configured to receive a sharpening element cartridge 200 when inserted from the open side. When so inserted, the sharpening element cartridge 200 is securely held by the confines of the wall structure 340, and by the latch formation on the ends of the latch arms 220 which engage in openings 345 of the wall structure provided for that purpose. One wall of the structure 340 has a locating groove 346 that operatively receives the ridge 215 of the cartridge. The sharpening element cartridge 200 can be released and removed from the carriage 300 by pressing on the release buttons 225 of the latch arms 220, which allows the cartridge to be pulled out.

The elongate body 310 of the storage carriage 300 has on each side a latch formation 330, just forward of the butt portion 302. When the elongate body 310 of the storage carriage is inserted into the hollow barrel until the flange of the butt portion is adjacent the rear edge of the tool body, outward protrusions on ends of the latch formations engage in respective openings 130 on sides of the handle portion. The protrusions on the latch formations 330 are preferably rounded to as to engage with a snap fit into the openings 130, but allow the storage carriage to be released and removed by pulling on the butt portion 302 without having to separately press in on the latch formations 330.

By selectively placing one of the two sharpening element cartridges 200 in the cartridge support housing 160 for operative use, and the other in the storage carriage 300, the sharpening device can be selectively configured for use on different types of tool blade edges. Once configured for the desired type of tool blade, the device can be used to sharpen the tool blade as diagrammatically illustrated in FIGS. 24-26. These drawings show, step-wise, movement of the sharpening device along the edge of a blade of a bypass secateurs tool 500. FIGS. 27-29 illustrate the same steps in perspective view from the opposite side.

The secateurs tool 500 as seen in the figures comprises two main components pivotally coupled to one another to allow a scissor action. One component has a first handle 510 and a cutting blade 512, the other component has a second handle 520 and a bypass blade 522. Although it may not be readily apparent in the figures, the structure of the tool 500 prevents the handles and blades from pivoting open any further than shown, perhaps even to a lesser extent. One of the reasons for this is that the tool normally includes a spring (not shown) that biases the handles/blades into an open configuration. Some form of limiting structure is then provided to limit the separation of the handles in the open configuration to one that can be grasped by the hand.

Sharpening of the tool cutting blade 512 using the sharpening device 10 involves drawing the sharpening elements 280 along the length of the blade edge 515 several times in a controlled manner. First, the forward end of the sharpening device carrying the sharpening element cartridge 200 is inserted into the space between the tool blades 512, 522 such that the cutting blade edge 515 rests in the slot 202 containing the sharpening elements. The end of the sharpening device 10 is initially located as close as possible to the juncture where the tool blades 512, 522 meet (FIGS. 24, 27). For optimal results the sharpening elements 280 should be oriented substantially orthogonal in relation to the cutting blade while allowing the user to apply some pressure. This arrangement is enabled by the structure of the support member 150, being angled downwardly in relation to the handle and having a central aperture 155 between the support arms 152, 153 that is able to accommodate the bypass blade 522, as seen particularly in FIGS. 24 and 27.

To sharpen the blade 512 the user will typically hold the tool first handle 510 in one hand and the sharpening device 10 in the other hand, drawing the sharpening elements 280 in the groove 202 along the length of the cutting blade edge 515, as shown in sequence in FIGS. 24-26 and 27-29. Over the length of the stroke, the handle of the sharpening device 10 should remain aligned with the blade edge, and the sharpening elements should remain substantially perpendicular to the portion of the blade edge with which it is in contact.

Although the illustrated embodiment of the sharpening device 10 described above includes only two different sharpening element cartridges 200 it is equally possible to provide more than two, with each individual sharpening element cartridge having a different sharpening element configuration adapted for sharpening a respective form of bladed tool. For example, cartridges with different sharpening element configurations (e.g. different angle arrangements of the sharpening elements) may be provided for use on bypass-type loppers/secateurs, anvil-type loppers/secateurs, knives/machetes/hoes/spades, hatchets/axes, etc. Yet other examples of cartridges comprise elements that are auxiliary to the sharpening process, for example, a deburring cartridge that includes a ceramic element for deburring a blade after it has been sharpened.

FIG. 30 illustrates another embodiment of the sharpening device 10' that is configured to hold more than one cartridge at a time for storage in the receptacle. The carriage body 310' is longer than the carriage body 310 of the preceding example, in order to receive more than one cartridge (in this example, the wall structure 340' of carriage body 310' can hold up to five cartridges). For ease of identification by the user, the individual cartridges adapted for different sharpening applications may be manufactured in different colours that are readily associated with the tools for which they are intended.

The embodiment 10' of FIG. 30 also illustrates another example of the mechanism for attaching the storage carriage 300' to the body 110 of the sharpener. The elongate body 310' of the storage carriage 300' has a latch 600 attached to a finger grip portion 610, just forward of the butt portion 302'. When the elongate body 310' of the storage carriage is inserted into the hollow barrel, the outward protrusion on the end of the latch 600 engages with a ridge 620 formed on the inside of the wall of the handle portion. The latch 600 elastically deflects as the storage carriage 300' is inserted into the body 110 so that the latch 600 snap fits to the ridge 620, locking the carriage 300' in place. To release the carriage 300', the user presses on the finger grip portion 610 to deflect the latch 600 and disengage it from the ridge 620.

The invention has been described by way of non-limiting example only and many modifications and variations may be made thereto without departing from the spirit and scope of the invention.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The following is a list of parts referred to in the described embodiments with corresponding reference numerals:

| | |
|---|---|
| 10, 10' | sharpening device |
| 100 | tool body |
| 110 | handle portion |
| 112 | thumb location depression |
| 120 | finger guard |
| 121 | handle web |
| 122 | attachment hole |
| 130 | carriage latch openings |
| 150 | support member |
| 152 | right support arm |
| 153 | left support arm |
| 155 | support member aperture |
| 160 | cartridge support housing |
| 163 | latch apertures |
| 165 | release button slots |
| 200 | sharpening element cartridge |
| 200A | anvil-type sharpening cartridge |
| 200B | bypass-type sharpening cartridge |
| 202 | V-shaped slot |
| 205 | cartridge body |
| 206 | latch arm gap |
| 210 | cartridge flange |
| 215 | cartridge body ridge |
| 220 | cartridge latch arms |
| 222 | sloped surface |
| 223 | ledge |
| 225 | release button |
| 280 | sharpening elements |
| 300, 300' | storage carriage |
| 302, 302' | storage carriage butt portion |
| 310, 310' | carriage body |
| 330 | carriage latch formations |
| 340, 340' | carriage wall structure |
| 345 | latch openings |
| 346 | locating groove |
| 500 | secateurs tool |
| 510 | first handle |
| 512 | cutting blade |
| 515 | cutting blade edge |
| 520 | second handle |
| 522 | bypass blade |
| 600 | latch |
| 610 | finger grip portion |
| 620 | ridge |

The invention claimed is:

1. A device for sharpening bladed tools comprising:

a body defining an elongate handle portion adapted to be gripped in one hand by a user, the body having a forwardly projecting support member curved or angled with respect to the handle portion, an end of the support member being configured to engage one of a plurality of sharpening element cartridges for operative use thereby defining an operative cartridge engagement position, the plurality of sharpening element cartridges each having a sharpening element, the body of the device also including a storage receptacle formed in the body and configured to receive at least one of the plurality of sharpening element cartridges for storage; and a carriage member adapted to receive and releasably engage with one or more of the plurality of sharpening element cartridges when not, in use, in the operative cartridge engagement position, the carriage member being adapted to engage with the device body while the one or more sharpening element cartridge carried thereby is received in the storage receptacle;

wherein the plurality of sharpening element cartridges are each selectively interchangeable with one another by the user as between the operative engagement position and the storage receptacle.

2. The device according to claim 1 further comprising:

the plurality of sharpening element cartridges, wherein each of the plurality of sharpening element cartridges has a distinct sharpening element configuration adapted for sharpening different tool blade types.

3. The device according to claim 1 further comprising:

the plurality of sharpening element cartridges; and wherein each of the plurality of sharpening element cartridges is provided with engaging features designed for snap fit or frictional engagement with features of the carriage member to, in use, secure the cartridge while stowed in the storage receptacle.

4. The device according to claim 3, wherein the storage receptacle comprises an interior cavity formed in the handle portion, into which the carriage member can slide.

5. The device according to claim 3, wherein the carriage member can hold two or more cartridges for storage.

6. The device according to claim 3, wherein the carriage member can hold at least five cartridges for storage.

7. The device according to claim 1, wherein the end of the support member is provided with a cartridge support housing defining the operative cartridge engagement position.

8. The device according to claim 7, wherein the support member comprises a pair of spaced support arms extending generally parallel to the longitudinal extent of the handle portion, the support arms terminating at respective sides of the cartridge support housing, wherein an aperture between the support arms serves to accommodate a blade or anvil of a tool during sharpening of a counterpart tool blade.

9. The device according to claim 7 further comprising:

the plurality of sharpening element cartridges, wherein each of the plurality of sharpening element cartridges is provided with alignment features that in use interfit with features of the cartridge support housing to ensure correct alignment of the cartridge when in the operative engagement position.

10. The device according to claim 9 further comprising:

the plurality of sharpening element cartridges, wherein each of the plurality of sharpening element cartridges is provided with engaging features designed for snap fit or frictional engagement with features of the cartridge support housing to in use secure the cartridge at the operative cartridge engagement position.

11. A device for sharpening bladed tools comprising:

a plurality of sharpening element cartridges each having a sharpening element;

a body defining an elongate handle portion adapted to be gripped in one hand by a user, the body having a support member projecting forwardly from the handle portion to an end having an operative cartridge engagement formation engaging with one of the plurality of sharpening element cartridges in an operative cartridge engagement position, wherein the support member comprises a pair of spaced support arms extending generally parallel to the longitudinal extent of the handle portion, the support arms being positioned to respective sides of the cartridge engagement formation and defining an aperture therebetween adapted to accommodate a blade or anvil of a tool during sharpening of a counterpart tool blade, the body of the device further including a storage receptacle; and a carriage member adapted to receive and releasably engage with the one or more sharpening element cartridges that are not, in use, in the operative cartridge engagement position, the carriage member being adapted to engage with the device body while the one or more sharpening element cartridge carried thereby is received in the storage receptacle;

wherein the device includes at least first and second sharpening element cartridges each of which is selectively interchangeable with one another and adapted to engage with the operative cartridge engagement formation or be placed in the storage receptacle according to user preference.

12. The device according to claim 11, wherein each of the plurality of sharpening element cartridges is provided with engaging features designed for snap fit or frictional engagement with features of the carriage member to in use secure the cartridge while stowed in the storage receptacle.

13. The device according to claim 11, wherein the storage receptacle comprises an interior cavity formed in the handle portion, into which the carriage member can slide.

14. The device according to claim 11, wherein the carriage member can hold two or more cartridges for storage.

15. The device according to claim 11, wherein the carriage member can hold at least five cartridges for storage.

16. The device according to claim 1 further comprising: the plurality of sharpening element cartridges, wherein each of the plurality of sharpening element cartridges is in an exposed position and accessible for sharpening when engaged with the support member in the operative engagement position.

17. The device according to claim 1 further comprising: the plurality of sharpening element cartridges, wherein each of the plurality of sharpening element cartridges is in a concealed position and inaccessible for sharpening when stored in the storage receptacle.

18. The device according to claim 11, wherein each of the plurality of sharpening element cartridges is in an exposed position and accessible for sharpening when engaged with the support member in the operative engagement position.

19. The device according to claim 11, wherein each of the plurality of sharpening element cartridges is in a concealed position and inaccessible for sharpening when stored in the storage receptacle.

20. The device according to claim 1 further comprising: the plurality of sharpening element cartridges, wherein the plurality of sharpening element cartridges are identical in structure to be selectively interchangeable with one another, with each sharpening element cartridge having a different sharpening element configuration adapted for sharpening a respective form of bladed tool.

21. The device according to claim 11, wherein the plurality of sharpening element cartridges are identical in structure to be selectively interchangeable with one another, with each sharpening element cartridge having a different sharpening element configuration adapted for sharpening a respective form of bladed tool.

22. The device according to claim 1 further comprising: the plurality of sharpening element cartridges, wherein each of the plurality of sharpening element cartridges has a flange with a forward tapered edge and a V-shaped slot centrally formed therein, the surface of the flange being substantially flush with the surface of the support member end where they meet.

23. The device according to claim 11, wherein each of the plurality of sharpening element cartridges has a flange with a forward tapered edge and a V-shaped slot centrally formed therein, the surface of the flange being substantially flush with the surface of the support member end where they meet.

24. The device according to claim 1 further comprising: the plurality of sharpening element cartridges, wherein each of the plurality of sharpening element cartridges is in a position in the storage receptacle that is 90 degrees to its position in the operative engagement position.

25. The device according to claim 11, wherein each of the plurality of sharpening element cartridges is in a position in the storage receptacle that is 90 degrees to its position in the operative engagement position.

26. The device according to claim 1, wherein the handle portion is a closed ring.

27. The device according to claim 11, wherein the handle portion is a closed ring.

28. The device according to claim 1 further comprising: the plurality of sharpening element cartridges, wherein when one of the plurality of sharpening element cartridges is coupled to the support member, the remainder of the plurality of sharpening element cartridges are coupled to the storage receptacle.

* * * * *